US010286447B2

(12) United States Patent
Kosugi et al.

(10) Patent No.: US 10,286,447 B2
(45) Date of Patent: May 14, 2019

(54) METHOD, APPARATUS, AND PROGRAM FOR DETERMINING CASTING STATE IN CONTINUOUS CASTING

(71) Applicant: NIPPON STEEL & SUMITOMO METAL CORPORATION, Tokyo (JP)

(72) Inventors: Satoshi Kosugi, Tokyo (JP); Kensuke Okazawa, Tokyo (JP); Junichi Nakagawa, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 303 days.

(21) Appl. No.: 15/112,049

(22) PCT Filed: Feb. 2, 2015

(86) PCT No.: PCT/JP2015/052884
§ 371 (c)(1),
(2) Date: Jul. 15, 2016

(87) PCT Pub. No.: WO2015/115651
PCT Pub. Date: Aug. 6, 2015

(65) Prior Publication Data

US 2016/0332221 A1 Nov. 17, 2016

(30) Foreign Application Priority Data

Jan. 31, 2014 (JP) ..... 2014-017443

(51) Int. Cl.
*B22D 11/18* (2006.01)
*B22D 11/20* (2006.01)
(Continued)

(52) U.S. Cl.
CPC ..... *B22D 11/207* (2013.01); *B22D 11/041* (2013.01); *B22D 11/055* (2013.01);
(Continued)

(58) Field of Classification Search
CPC ..... B22D 11/041; B22D 11/055; B22D 11/16; B22D 11/18–11/188; B22D 11/20–11/208; B22D 11/22
See application file for complete search history.

(56) References Cited

U.S. PATENT DOCUMENTS

2004/0256080 A1* 12/2004 Rahmfeld ..... B22D 11/055 164/485
2015/0204837 A1* 7/2015 Han ..... B22D 11/16 702/182

FOREIGN PATENT DOCUMENTS

CN 101879583 A 11/2010
EP 1166921 A1 1/2002
(Continued)

OTHER PUBLICATIONS

EPO machine translation of JP 2011-251302 (Year: 2011).*
(Continued)

*Primary Examiner* — Kevin E Yoon
(74) *Attorney, Agent, or Firm* — Birch, Stewart, Kolasch & Birch, LLP

(57) ABSTRACT

A heat transfer coefficient α between a solidified shell (2) and a mold (4) sandwiching a mold flux layer (3), and a heat transfer coefficient β between a molten steel (1) and the solidified shell (2) are found by solving an inverse problem by using data from thermocouples (6), and a solidified shell thickness and a solidified shell temperature are estimated (solidified state in mold estimation amounts), and further, solidified state in mold evaluation amounts are obtained. It is determined whether a normal casting state or an abnormal casting state by comparing at least one or more kinds of amounts contained in the solidified state in mold estimation amounts and the solidified state in mold evaluation amounts with allowable limit values which are found based on at least one or more kinds of amounts contained in the solidified
(Continued)

state in mold estimation amounts and the solidified state in mold evaluation amounts when the abnormal casting occurred in a past and stored in a data storage part.

9 Claims, 12 Drawing Sheets

(51) Int. Cl.
*B22D 11/22* (2006.01)
*B22D 11/041* (2006.01)
*B22D 11/055* (2006.01)

(52) U.S. Cl.
CPC ..... *B22D 11/188* (2013.01); *B22D 11/202* (2013.01); *B22D 11/22* (2013.01)

(56) References Cited

FOREIGN PATENT DOCUMENTS

| | | | |
|---|---|---|---|
| JP | 57-152356 | A | 9/1982 |
| JP | 2-52158 | A | 2/1990 |
| JP | 2001-239353 | A | 9/2001 |
| JP | 2011-245507 | A | 12/2011 |
| JP | 2011-251302 | A | 12/2011 |
| JP | 2011-251307 | A | 12/2011 |
| JP | 2011-251308 | A | 12/2011 |

OTHER PUBLICATIONS

International Preliminary Report on Patentability and translation of the Written Opinion of the International Searching Authority (Forms PCT/IB/338, PCT/IB/373 and PCT/ISA/237) for International Application No. PCT/JP2015/052884, dated Aug. 11, 2016.
Emling, "Breakout prevention," Keeping Current II, Iron and Steelmaker, Oct. 1, 1994, p. 50 (14 pages total), XP055404661.
Extended European Search Report, dated Sep. 19, 2017, for corresponding European Application No. 15743910.0.
Xia et al., "Investigation of mould thermal behaviour by means of mould instrumentation," Ironmaking & Steelmaking, vol. 31, No. 5, Oct. 1, 2004, pp. 364-370, XP009094716.
Edited by the Iron and Steel Institute of Japan, "Handbook of Iron and Steel (4th edition)", published by the Iron and Steel Institute of Japan (2002), total 209 pages.
International Search Report for PCT/JP2015/052884 dated Apr. 21, 2015.
Nakato, "Tetsu-to-Hagane", vol. 62, No. 11, p. S506 (1976).
Written Opinion of the International Searching Authority for PCT/JP2015/052884 (PCT/ISA/237) dated Apr. 21, 2015.

* cited by examiner

METHOD, APPARATUS, AND PROGRAM FOR DETERMINING CASTING STATE IN CONTINUOUS CASTING

TECHNICAL FIELD

The present invention relates to a method, an apparatus, and a program for determining a casting state in continuous casting where a solidified shell, a mold flux layer, and a mold exist between a molten steel to mold-cooling water.

BACKGROUND ART

An outline of a continuous casting equipment is illustrated in FIG. 19. A molten steel prepared by a steel converter and secondary refining is put into a ladle 51, and poured into a mold 4 through a tundish 52. The molten steel which is in contact with the mold 4 is cooled and solidified, transported by rolls 54 while a casting speed thereof is controlled, and cut into a proper length by a gas cutting machine 55. In the continuous casting of steel as stated above, there is a possibility that a fluid state and a solidified state of the molten steel in the mold 4 incur a casting stop due to a deterioration trouble of properties of a cast slab. It is therefore necessary to estimate and control the state in the mold by online to enable stable casting and to manufacture a cast slab without defect.

A cross section of the continuous casting equipment in a vicinity of a mold is illustrated in FIG. 20. A reference numeral 1 is molten steel, a reference numeral 2 is a solidified shell, a reference numeral 3 is a mold flux layer, a reference numeral 4 is a mold, a reference numeral 5 is cooling water, and a reference numeral 8 is an immersion nozzle.

As illustrated in FIG. 20, the molten steel 1 is poured from the immersion nozzle 8 into the mold 4, and a cast slab whose side surface is solidified is pulled out of a bottom of the mold 4 in a process of the continuous casting. There are unsolidified parts in the cast slab in a vicinity of a lower end of the mold 4, and they are entirely solidified at a secondary cooling part at a lower layer than the mold 4.

In an operation of the continuous casting, high-speed casting is aimed to enable improvement in productivity. However, when the casting speed is too fast, the solidified shell 2 being the cast slab which is solidified at the side surface of the mold 4 is pulled outside the mold 4 with insufficient strength, and an operation trouble called as a break-out is incurred because the solidified shell 2 is broken and the molten steel 1 outflows in the continuous casting equipment in an extreme case. Once the break-out occurs, the operation is stopped to perform removal of the steel which outflows and is solidified in the equipment and repair of the equipment, as a result, a lot of time is required to recover the operation, and there is a large loss.

There are proposed various casting technologies such as development of a high-speed casting powder, improvement in a cooling mechanism of a mold copper plate, and a temperature management to enable a stable high-speed casting without generating the operation trouble such as the break-out (Non-Patent Literature 1).

Besides, there is also proposed a technology in which soundness of a solidified shell in a mold is diagnosed from measurement values of mold temperatures or the like, a casting state is determined whether or not it leads to a break-out to control a casting speed or the like by using the determination result. For example, in Patent Literature 1, there is proposed a detection technology of a restrictive break-out. In this example, the restrictive break-out is avoided by measuring temperatures by thermocouples embedded in a mold, capturing a time-series change of characteristic thermocouple temperatures observed when a shell fracture occurs resulting that the solidified shell is restricted to the mold, recognizing a fracture surface of the solidified shell in the mold, and decreasing a casting speed before the fracture surface reaches a lower end of the mold.

However, the break-out is not limited to the restrictive one, and there are ones each of whose sign of the break-out is difficult to appear in a temperature waveform representing the time-series change of the temperature. One of them is a break-out due to drift. The break-out due to drift is a break-out which occurs when unexpected circumstances such as drift of a molten steel flow in the mold 4 or the like occur, a heat quantity over cooling capacity of the mold 4 is locally applied to the solidified shell 2 to inhibit a solidification growth, and the solidified shell 2 with insufficient strength is pulled outside the mold 4. In the continuous casting, the molten steel 1 is poured from the immersion nozzle 8 into the mold 4, but there is a case when the break-out due to drift is induced when erosion of the immersion nozzle 8 occurs, a discharge port excessively deforms caused by generated inclusions, for example, during casting. It is difficult to directly observe a drift phenomenon, and characteristics thereof are difficult to appear also in the mold temperature waveform different from the restrictive break-out.

As a detection technology of the break-out due to drift as stated above, there are proposed development of technologies such that it becomes possible to estimate a state in a mold owing to an inverse problem method where other information such as the casting speed and a cooling water temperature are taken into account in addition to the mold temperature, and the occurrence of the break-out is prevented as described in Patent Literatures 2 to 5. In Patent Literature 2, there is described the inverse problem method estimating the solidified state in the continuous casting. Besides, in Patent Literatures 3 to 5, there is described a method controlling casting to avoid an operation trouble by using estimation amounts representing the state in the mold obtained by the method according to Patent Literature 2. However, in Patent Literatures 3 to 5, there are proposed a method to determine an abnormal casting state leading to the break-out and an avoidance method, but they are not generalized, and a concrete method to determine allowable limit values to determine the abnormal casting is not specified. Accordingly, when the technologies described in Patent Literatures 3 to 5 are actually used, it is often the case to rely on an experience of an executant. Besides, there is not referred to cases when there are differences in variations of estimation results depending on casting conditions, and therefore, there is a possibility that excessively low allowable limit values are set.

Besides, there is also proposed a technology estimating a heat flux from temperatures measured at a plurality of points in a mold by using a heat transfer inverse problem method to detect the break-out (Patent Literature 6).

CITATION LIST

Patent Literatures

Patent Literature 1: Japanese Laid-open Patent Publication No. S57-152356

Patent Literature 2: Japanese Laid-open Patent Publication No. 2011-245507

Patent Literature 3: Japanese Laid-open Patent Publication No. 2011-251302

Patent Literature 4: Japanese Laid-open Patent Publication No. 2011-251307

Patent Literature 5: Japanese Laid-open Patent Publication No. 2011-251308

Patent Literature 6: Japanese Laid-open Patent Publication No. 2001-239353

Non-Patent Literatures

Non-Patent Literature 1: Edited by The Iron and Steel Institute of Japan, "Handbook of Iron and Steel (4th edition)", published by The Iron and Steel Institute of Japan (2002)

Non-Patent Literature 2: Nakato or the like, "Tetsu-to-Hagane" Vol. 62, No. 11, Page. 5506 (1976)

SUMMARY OF INVENTION

Technical Problem

An object of the present invention is to provide a detection technology of a break-out due to drift with little overdetection and detection leakage by deciding concrete allowable limit values regarding amounts containing a solidified shell temperature and a solidified shell thickness to determine an abnormal state of continuous casting.

Solution to Problem

Summary of the present invention to solve the above-stated problems is as follows.

[1] A determination method of a casting state in continuous casting where there are a solidified shell, a mold flux layer, and a mold being respective thermal conductors between a molten steel and cooling water for the mold, the determination method includes:

a first step of finding a heat transfer coefficient $\alpha$ being a heat flux per a unit temperature difference between the solidified shell and the mold sandwiching the mold flux layer and a heat transfer coefficient $\beta$ between the molten steel and the solidified shell by using data from a plurality of temperature sensing units which are embedded in the mold while shifting positions in a casting direction by solving an inverse problem, and estimating a solidified shell thickness and a solidified shell temperature from the heat transfer coefficient $\alpha$ and the heat transfer coefficient $\beta$;

a second step of setting the heat transfer coefficient $\alpha$, the heat transfer coefficient $\beta$, the solidified shell estimated thickness, and the solidified shell estimated temperature found in the first step as solidified state in mold estimation amounts, and obtaining solidified state in mold evaluation amounts from the solidified state in mold estimation amounts; and a third step of determining whether a normal casting state or an abnormal casting state by comparing at least one or more kinds of amounts contained in the solidified state in mold estimation amounts and the solidified state in mold evaluation amounts obtained in the second step with allowable limit values which are found based on at least one or more kinds of amounts contained in the solidified state in mold estimation amounts and the solidified state in mold evaluation amounts when the abnormal casting occurred in a past, and stored in an allowable limit value storage unit, wherein in the mold where widths in a horizontal direction of two planes which are not adjacent but face each other are equal from among four planes of mold surfaces which are in contact with a cast slab through the mold flux layer, two planes whose widths in the horizontal direction are narrower than the other two planes are called as short sides, a difference of the heat transfer coefficients $\beta$ obtained at the short sides at the same mold height position is called as a short side $\beta$ difference, a difference of solidified shell thicknesses obtained at the short sides at the same mold height position is called as a short side shell thickness difference, and the solidified state in mold evaluation amounts are calculated from at least either the short side $\beta$ difference or the short side shell thickness difference.

[2] The determination method of the casting state according to [1], wherein in the third step, occurrence of a break-out is determined as the determination of whether the normal casting state or the abnormal casting state.

[3] The determination method of the casting state according to [1] or [2], further includes: a time-series data storing step of setting at least one or more kinds of amounts contained in the solidified state in mold estimation amounts and the solidified state in mold evaluation amounts obtained in the second step as a time-series data, and storing in a data storage unit together with information of whether or not the abnormal casting occurred; and an allowable limit value storing step of deciding the allowable limit values defining a range regarded to be the normal casting state based on the time-series data when the abnormal casting occurred and statistic information including an average and a standard deviation of the time-series data, and storing in the allowable limit value storing unit.

[4] The determination method of the casting state according to any one of [1] to [3], wherein the solidified state in mold evaluation amount is a moving average from one second to 15 minutes in a past of at least either the short side $\beta$ difference or the short side shell thickness difference.

[5] The determination method of the casting state according to any one of [1] to [3], wherein the solidified state in mold evaluation amount is a minimum value from one second to 15 minutes in a past of at least either an absolute value of the short side $\beta$ difference or an absolute value of the short side shell thickness difference.

[6] The determination method of the casting state according to [3], wherein at least one or more kinds of amounts contained in the solidified state in mold estimation amounts and the solidified state in mold evaluation amounts are classified by layers in accordance with classifications for casting conditions and measurement values defined in advance, and the statistic information is at least either the average or the standard deviation in each group classified by layers.

[7] The determination method of the casting state according to [6], wherein the casting conditions and the measurement values are one or more kinds from among a casting speed, a casting width, a molten steel temperature, a difference between the molten steel temperature and a liquidus temperature, and a difference between the molten steel temperature and a solidus temperature.

[8] The determination method of the casting state according to [3], wherein a value where one time or more value of the standard deviation is added to the average and a value where one time or more value of the standard deviation is subtracted from the average are used as the allowable limit values.

[9] The determination method of the casting state according to any one of [1] to [8], wherein an arbitrary position at "0" (zero) mm or more and 95 mm or less downward from a supposed molten steel surface level position of the mold is set to $P_1$, an arbitrary position at 220 mm or more and 400 mm or less downward from the molten steel surface level position is set to $P_2$, and embedding positions of the temperature sensing units are provided at intervals of 120 mm or less within a range from $P_1$ to $P_2$, and at least one point is provided at a position where a distance from a lower end of the mold is within 300 mm.

[10] A determination apparatus of a casting state in continuous casting where there are a solidified shell, a mold flux layer, and a mold being respective thermal conductors between a molten steel and cooling water for the mold, the determination apparatus includes:

an estimation unit which finds a heat transfer coefficient $\alpha$ being a heat flux per a unit temperature difference between the solidified shell and the mold sandwiching the mold flux layer and a heat transfer coefficient $\beta$ between the molten steel and the solidified shell by using data from a plurality of temperature sensing units which are embedded in the mold while shifting positions in a casting direction by solving an inverse problem, and estimates a solidified shell thickness and a solidified shell temperature from the heat transfer coefficient $\alpha$ and the heat transfer coefficient $\beta$;

a calculation unit which sets the heat transfer coefficient $\alpha$, the heat transfer coefficient $\beta$, the solidified shell estimated thickness, and the solidified shell estimated temperature found by the estimation unit as solidified state in mold estimation amounts, and obtains solidified state in mold evaluation amounts from the solidified state in mold estimation amounts; and a determination unit which determines whether a normal casting state or an abnormal casting state by comparing at least one or more kinds of amounts contained in the solidified state in mold estimation amounts and the solidified state in mold evaluation amounts obtained by the calculation unit with allowable limit values which are found based on at least one or more kinds of amounts contained in the solidified state in mold estimation amounts and the solidified state in mold evaluation amounts when the abnormal casting occurred in a past and stored in an allowable limit value storage unit, wherein in the mold where widths in a horizontal direction of two planes which are not adjacent but face each other are equal from among four planes of mold surfaces which are in contact with a cast slab through the mold flux layer, two planes whose widths in the horizontal direction are narrower than the other two planes are called as short sides, a difference of the heat transfer coefficients $\beta$ obtained at the short sides at the same mold height position is called as a short side $\beta$ difference, a difference of solidified shell thicknesses obtained at the short sides at the same mold height position is called as a short side shell thickness difference, and the solidified state in mold evaluation amounts are calculated from at least either the short side $\beta$ difference or the short side shell thickness difference.

[11] The determination apparatus of the casting state according to [10], wherein an arbitrary position at 120 mm or more and 175 mm or less from an upper end of the mold is set to $P_1$, an arbitrary position at 340 mm or more and 480 mm or less from the upper end of the mold is set to $P_2$, and embedding positions of the temperature sensing units are provided at intervals of 120 mm or less within a range from $P_1$ to $P_2$, and at least one point is provided at a position where a distance from a lower end of the mold is within 300 mm.

[12] A computer program for causing a computer to determine a casting state in continuous casting where there are a solidified shell, a mold flux layer, and a mold being respective thermal conductors between a molten steel and cooling water for the mold, the computer program causes a computer to execute:

a first process of finding a heat transfer coefficient $\alpha$ being a heat flux per a unit temperature difference between the solidified shell and the mold sandwiching the mold flux layer and a heat transfer coefficient $\beta$ between the molten steel and the solidified shell by using data from a plurality of temperature sensing units which are embedded in the mold while shifting positions in a casting direction by solving an inverse problem, and estimating a solidified shell thickness and a solidified shell temperature from the heat transfer coefficient $\alpha$ and the heat transfer coefficient $\beta$;

a second process of setting the heat transfer coefficient $\alpha$, the heat transfer coefficient $\beta$, the solidified shell estimated thickness, and the solidified shell estimated temperature found by the first process as solidified state in mold estimation amounts, and obtaining solidified state in mold evaluation amounts from the solidified state in mold estimation amounts; and a third process of determining whether a normal casting state or an abnormal casting state by comparing at least one or more kinds of amounts contained in the solidified state in mold estimation amounts and the solidified state in mold evaluation amounts obtained by the second process with allowable limit values which are found based on at least one or more kinds of amounts contained in the solidified state in mold estimation amounts and the solidified state in mold evaluation amounts when the abnormal casting occurred in a past and stored in an allowable limit value storage unit, wherein in the mold where widths in a horizontal direction of two planes which are not adjacent but face each other are equal from among four planes of mold surfaces which are in contact with a cast slab through the mold flux layer, two planes whose widths in the horizontal direction are narrower than the other two planes are called as short sides, a difference of the heat transfer coefficients $\beta$ obtained at the short sides at the same mold height position is called as a short side $\beta$ difference, a difference of solidified shell thicknesses obtained at the short sides at the same mold height position is called as a short side shell thickness difference, and the solidified state in mold evaluation amounts are calculated from at least either the short side $\beta$ difference or the short side shell thickness difference.

Advantageous Effects of Invention

According to the present invention, it is possible to decide concrete allowable limit values regarding amounts containing a solidified shell temperature and a solidified shell thickness to determine an abnormal state of continuous casting, and therefore, executors are able to decide the allowable limit values independent from experiences. It is thereby possible to provide a detection technology of a break-out due to drift with little overdetection and detection leakage to improve accuracy of a state determination of a casting state. Occurrence of operational accidents such as a break-out due to drift is therefore prevented, and it contributes to improvement in productivity by relaxing restriction in a casting speed which is set so as to avoid the operational accidents.

DESCRIPTION OF EMBODIMENTS

Hereinafter, embodiments of the present invention are described with reference to the attached drawings.

At first, a partial differential equation to be a mathematical model which simulates a solidification heat-transfer phenomenon in a mold in continuous casting and derivation of an approximate solution by a profile method, and an inverse problem in which a solidified state in the mold is estimated by using the approximate solution corresponding to the technology in Patent Literature 2 are made clear, and the solution is described.

Next, when an inverse problem method estimating the solidified state in the mold is applied to an early detection of a break-out due to drift being an operation failure, a decision method of concrete allowable limit values of a solidified shell temperature and a solidified shell thickness to determine an abnormal casting being a principle part of the present invention is described.

Figure 2:
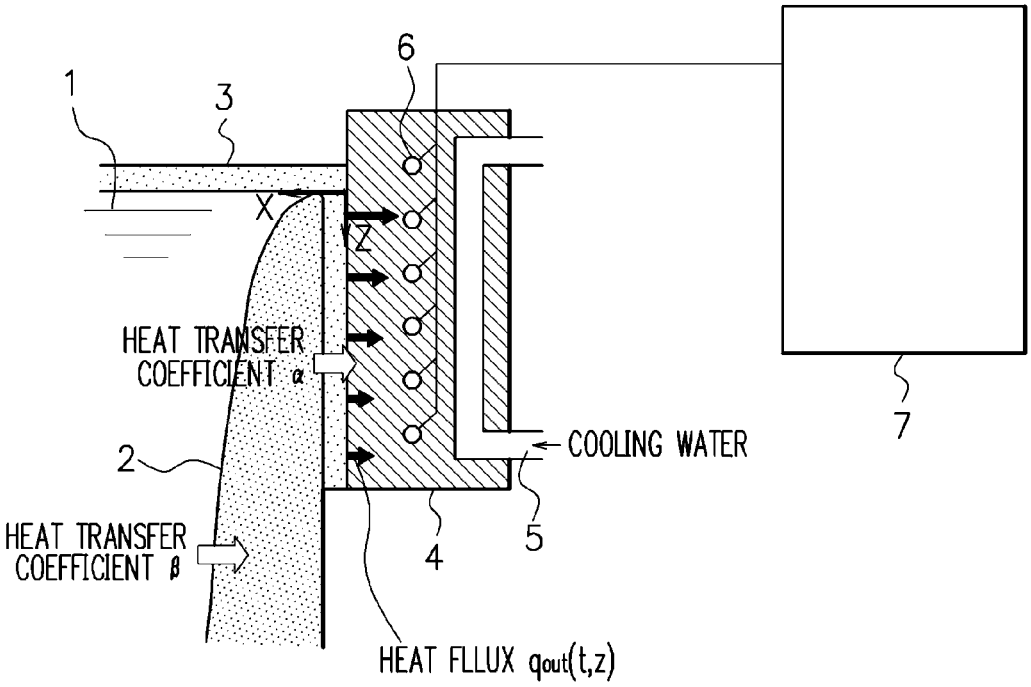
FIG. 2 is a view illustrating a part of a cross section in a vicinity of a mold of a continuous casting equipment and an information processing apparatus.

FIG. 2 illustrates a part (a right half except an immersion nozzle) of a cross section in a vicinity of a mold of a continuous casting equipment. There are a solidified shell 2, a mold flux layer 3, and a mold 4 being respective thermal conductors between a molten steel 1 and cooling water 5 for the mold. Thermocouples 6 being a plurality of temperature sensing units are embedded in the mold 4 in a casting direction, namely, while shifting their positions downward in the drawing. Besides, an information processing apparatus 7 functioning as a determination apparatus of a casting state is equipped.

[Embedding Positions of Temperature Sensing Units]

Suitable embedding positions of the temperature sensing units are described when estimation of the solidified state in the mold is performed by applying the present invention.

It is possible to estimate the solidified state in the mold if the embedding positions of the temperature sensing units are set under a conventionally used state to monitor the casting state. However, it is preferable that an arbitrary position within 95 mm under a supposed molten steel surface level of the mold is set to $P_1$, an arbitrary position at 220 mm or more and 400 mm or less under the molten steel surface level is set to $P_2$, they are provided at intervals of 120 mm or less within a range from $P_1$ to $P_2$, and at least one point is provided at a position within 300 mm from a lower end of the mold.

Figure 3:
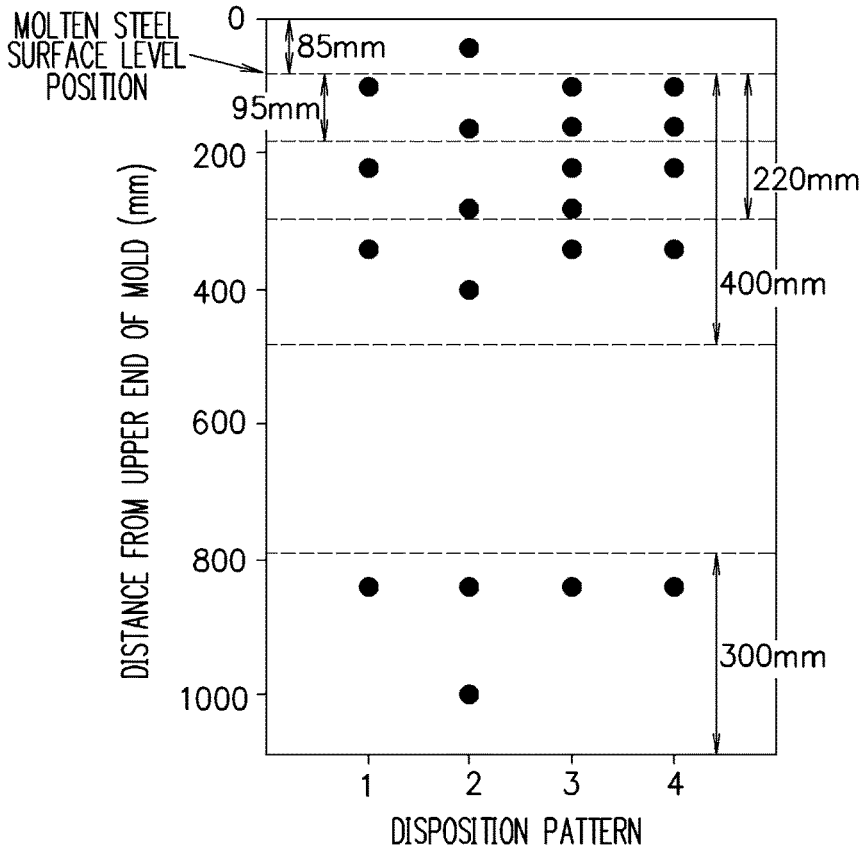
FIG. 3 is a view illustrating examples of suitable embedding positions of temperature sensing units according to the embodiment.

FIG. 3 is a view illustrating examples of the suitable embedding positions of the temperature sensing units (• in FIG. 3) in a mold with a length of 1090 mm where the supposed molten steel surface level exists at a position of 85 mm from an upper end of the mold.

A disposition pattern 1 is a pattern providing at intervals of 120 mm within a range of 100 mm or more and 340 mm or less from the upper end of the mold, and providing one point at a position of 250 mm from the lower end of the mold.

A disposition pattern 2 is a pattern providing at intervals of 120 mm within a range of 40 mm or more and 400 mm or less from the upper end of the mold, and providing two points up to the position of 250 mm from the lower end of the mold.

A disposition pattern 3 is a pattern providing at intervals of 60 mm within a range of 100 mm or more and 340 mm or less from the upper end of the mold, and providing one point at the position of 250 mm from the lower end of the mold.

A disposition pattern 4 is a pattern providing at intervals of 120 mm or less to have irregular intervals within a range of 100 mm or more and 340 mm or less from the upper end of the mold, and providing one point at the position of 250 mm from the lower end of the mold.

Next, reasons why the above-stated embedding positions are preferable are described. In the present invention, a state in the mold is estimated by using a temperature distribution of the mold, and therefore, it is preferable that measurement is performed such that the temperature distribution of the mold is faithfully reproduced as much as possible. The measurement is to be performed by embedding the temperature sensing units in the mold with high density to enable the faithful reproduction of the mold temperature distribution, but each temperature sensing unit is an apparatus, and therefore, it gets out of order at a certain probability. If an embedding density of the temperature sensing units is made high, a total failure probability of a plurality of temperature sensing units increases, and in addition, operation cost increases due to an expensive construction cost. Accordingly, it is necessary to perform the measurement properly by embedding the temperature sensing units in the mold so as to enable the faithful reproduction of the temperature distribution of the mold by using the temperature sensing units as little as possible within an allowable degree.

In a general continuous casting machine, a molten steel injection amount is adjusted such that the molten steel surface level positions at a distance of 80 mm or more and 120 mm or less from the upper end of the mold for safety reasons such that the temperature at the upper end of the mold does not become high, the molten steel does not spill out even when the surface level varies largely. An inner surface of the mold at an upper side than the molten steel surface level is therefore exposed to the outside air, and the upper end part of the mold has a lowest temperature to be approximately the same temperature as a cooling water temperature even during the casting. Though the mold temperature changes depending on casting conditions, the mold temperature increases from the upper end of the mold toward a vicinity of the molten steel surface level, a maximum temperature position of the mold exists from the molten steel surface level to approximately 100 mm or less under the molten steel surface level, the mold temperature has a downward trend from the maximum temperature position of the mold toward the lower end of the mold, and reaches a minimum temperature of the molten steel surface level or less within 300 mm from the lower end of the mold.

Figure 4:
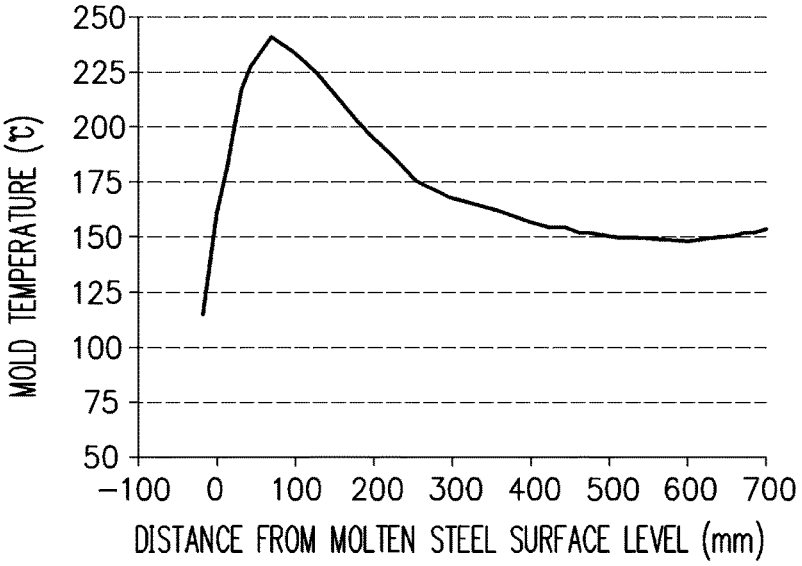
FIG. 4 is a characteristic chart illustrating a typical mold temperature distribution.

FIG. 4 is a typical mold temperature distribution in case when the molten steel surface level position is 100 mm from the upper end of the mold in the mold with a length of 900 mm which is prepared based on a mold temperature measurement result disclosed in Non-Patent Literature 2. The inventors thought that it was possible to derive suitable embedding positions of the temperature sensing units from the typical temperature distribution. Namely, they thought that a finite number of temperature information was obtained from the typical temperature distribution, and a temperature information obtained position where the original temperature distribution is finely approximated was the suitable embedding position of the temperature sensing unit when the temperature distribution is reproduced by a linear interpolation.

The temperature sensing units are densely disposed at a range where a temperature gradient is large or a change of the temperature gradient is large, and the temperature sensing units are sparsely disposed at a range where the temperature gradient is relatively small to faithfully reproduce the temperature distribution of the mold. When it is considered to estimate the casting state in the mold by using the temperature distribution from under the molten steel surface level to a lowermost temperature sensing unit, it turns out that the temperature sensing units are densely embedded under the molten steel surface level at an upper side of the mold, and the temperature sensing units are coarsely embedded at a lower side of the mold. It is therefore necessary to decide the temperature sensing position $P_2$ to be a boundary between the range to be densely embedded and the range to be coarsely embedded.

Figure 5:
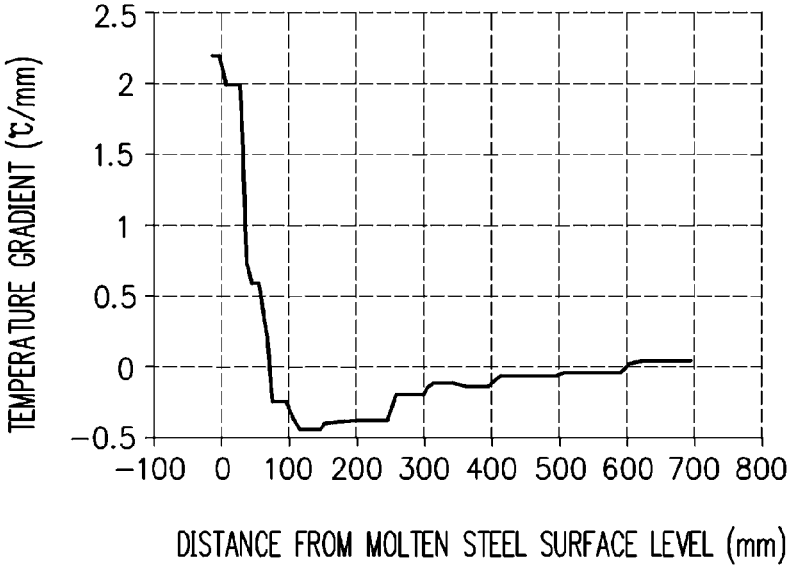
FIG. 5 is a characteristic chart illustrating a temperature gradient in the typical mold temperature distribution.

FIG. 5 is a graphic chart of the temperature gradient of the typical temperature distribution. There is the boundary between the range to be densely embedded and the range to be coarsely embedded at a range from a position of 100 mm under the surface level where the temperature gradient under the molten steel surface level turns from positive to negative and the change of the temperature gradient becomes small compared to the vicinity of the molten steel surface level to a position of 200 mm from the lower end of the mold where the temperature reaches the minimum under the molten steel surface level. The temperature sensing position $P_2$ to be the boundary is decided by the following method. Namely, there is calculated an approximate temperature distribution which is linearly interpolated by using temperatures of three points at the position of 100 mm under the molten steel surface level, the position of 200 mm from the lower end of the mold, and an intermediate position between the above, a root-mean-square of a relative difference from the typical temperature distribution is found, and the intermediate position where the relative difference becomes small to be within an allowable degree is set to $P_2$.

Figure 6:
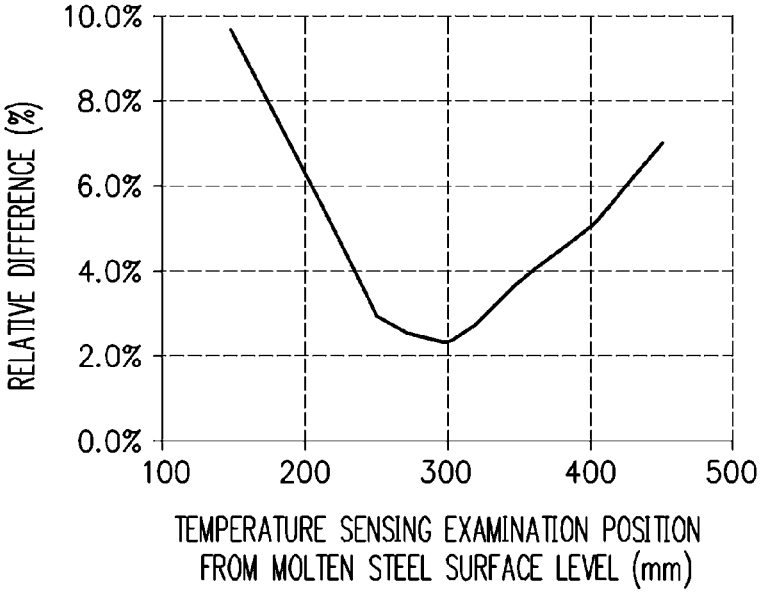
FIG. 6 is a characteristic chart illustrating approximation accuracy of a mold temperature distribution which is linearly interpolated according to the embodiment.

FIG. 6 is a graphic chart illustrating the root-mean-square of the relative difference for the intermediate position. When the intermediate position is 300 mm under the molten steel surface level, the root-mean square of the relative difference becomes 2.3% to be a best approximation, and a condition of the temperature sensing position $P_2$ is set to suppress the value to 5% or less being about double of the best approximation. Namely, the temperature sensing position $P_2$ is set at 200 mm or more and 400 mm or less from the molten steel surface level.

Figure 7:
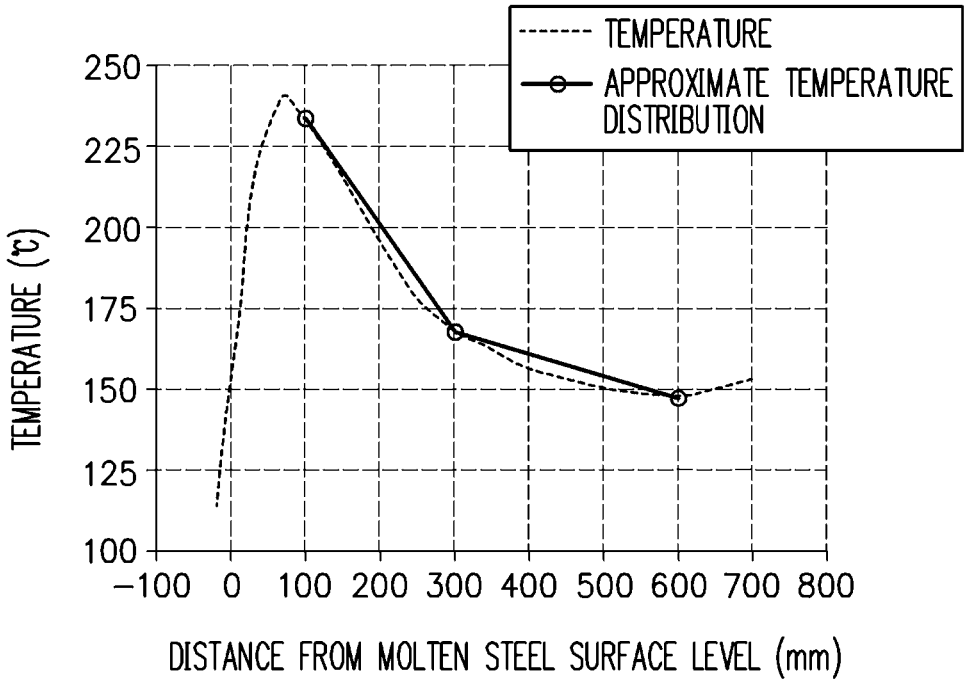
FIG. 7 is a characteristic chart illustrating the mold temperature distribution which is linearly interpolated according to the embodiment.

FIG. 7 is a graphic chart illustrating the typical temperature distribution and an approximate temperature distribution where the temperature sensing position $P_2$ is set at 300 mm under the molten steel surface level. It can be seen that the mold temperature distribution can be accurately and effectively reproduced by embedding the temperature sensing units within the above-stated range.

It is desirable that at least one point is provided at a position within 300 mm from the lower end of the mold regarding a disposition at a lower side than the temperature sensing position $P_2$, because the temperature reaches the minimum within 300 mm from the lower end of the mold. A disposition at an upper side than the temperature sensing position $P_2$ is decided as follows from results of the example 1. Namely, the temperature sensing position $P_1$ at an uppermost of the range to be densely embedded is set within 95 mm under the molten steel surface level, and each interval disposing the temperature sensing unit is set to 120 mm or less.

For the reasons as stated above, it is preferable as the embedding positions of the temperature sensing units that the arbitrary position within 95 mm from the supposed molten steel surface level position of the mold is set to $P_1$, the arbitrary position at 220 mm or more and 400 mm or less under the molten steel surface level is set to $P_2$, the temperature sensing units are provided at intervals of 120 mm or less within the range from $P_1$ to $P_2$, and at least one point is provided at the position within 300 mm from the lower end of the mold.

As stated above, in the general continuous casting machine, the molten steel injection amount is adjusted such that the distance of the molten steel surface level from the upper end of the mold is at a position of 80 mm or more and 120 mm or less. Accordingly, when $P_1$ is set at the arbitrary position of 120 mm or more and 175 mm or less from the upper end of the mold, and $P_2$ is set at the arbitrary position of 340 mm or more and 480 mm or less from the upper end of the mold, the suitable condition of the embedding positions of the temperature sensing units is satisfied regardless of the position of the molten steel surface level.

[Estimation Method of Solidified State in Mold]

The mathematical model used in the present embodiment is described. In general, there are a plurality of options in the mathematical models to represent the same phenomenon because different mathematical models are conceivable by simplifying components to be factors of the phenomenon. The mathematical model usable in the present invention is the mathematical model representing a solidification heat-transfer phenomenon within a range from the molten metal to the solidified shell 2, the mold flux layer 3, the mold 4, and the cooling water 5 on a two-dimensional cross section made up of two directions of a mold surface vertical direction and a casting direction, as illustrated in FIG. 2. In addition, a later-described inverse problem is established within a frame of the mathematical model, and the inverse problem can be numerically and approximately solved. At present, there are a partial differential equation where the expressions (1) to (5) representing the solidification heat-transfer phenomenon in the mold are simultaneously set up, and the expressions (6) to (8) representing a heat flux passing through the mold 4 in different expressions are combined from among the models satisfying the above-stated conditions which can be executed on a computer.

[mathematical expression 1]

$$c_s \cdot \rho_s \cdot \left(\frac{\partial T}{\partial t} + V_c \cdot \frac{\partial T}{\partial z}\right) = \lambda_s \cdot \frac{\partial^2 T}{\partial x^2}, \quad x \in (0, s), z \in (0, z_e), t > 0 \tag{1}$$

$$\lambda_s \cdot \frac{\partial T}{\partial x} = \alpha \cdot (T - T_m), x = 0, z \in (0, z_e), t > 0 \tag{2}$$

$$\lambda_s \cdot \frac{\partial T}{\partial x} = \rho_s \cdot L \cdot \left(\frac{\partial s}{\partial t} + V_c \cdot \frac{\partial s}{\partial z}\right) + \beta \cdot (T_0 - T_s), \quad x = s, z \in (0, z_e), t > 0 \tag{3}$$

$$T = T_s, x = s, z \in (0, z_e), t > 0 \tag{4}$$

$$s = 0, z = 0, t > 0 \tag{5}$$

[mathematical expression 2]

$$q_{out} = \alpha \cdot (T|_{x=0} - T_m), z \in (0, z_e), t > 0 \tag{6}$$

$$q_{out} = \frac{\lambda_m}{d_1} \cdot (T_m - T_c), z \in (0, z_e), t > 0 \tag{7}$$

$$q_{out} = \frac{1}{\frac{1}{h_w} + \frac{d_2}{\lambda_m}} \cdot (T_c - T_w), z \in (0, z_e), t > 0 \tag{8}$$

Here, t is a time. z is a coordinate in the casting direction when "z=0" is set to the molten steel surface level, x is a coordinate in the mold vertical direction when "x=0" is set to a mold surface. $z_e$ is a position of the lowermost thermocouple 6 embedded in the mold 4. $C_s$ is a solidified shell specific heat, $\rho_s$ is a solidified shell density, $\lambda_s$ is a solidified shell heat conductivity, and L is a solidification latent heat. $V_c$ is a casting speed. $T_0$ is a molten steel temperature, $T_s$ is a solidification temperature, "$T_m$=$T_m$(t, z)" is a mold surface temperature, "T=T(t, z, x)" is a solidified shell temperature. "s=s(t, z)" is a solidified shell thickness. "α=α(t, z)" is a heat transfer coefficient between the solidified shell 2 and the mold 4, "β=β(t, z)" is a heat transfer coefficient between the molten steel 1 and the solidified shell 2. "$q_{out}$=$q_{out}$ (t, z)" is a heat flux passing through the mold 4. $\lambda_m$ is a mold heat conductivity. $d_1$ is a thermocouple embedded depth from the mold surface, $d_2$ is a distance from the thermocouple 6 to the cooling water 5. $h_w$ is a heat transfer coefficient between the mold and the cooling water. "$T_c$=$T_c$(t, z)" is a mold temperature at a thermocouple embedded depth position, and "$T_w$=$T_w$(t, z)" is a cooling water temperature.

This mathematical model is a combination between a model which simulates a state in the mold where a temperature change seldom occurs in a horizontal direction in parallel to the mold surface, and the heat flux in the casting direction in the solidified shell 2 is extremely small compared to the mold surface vertical direction and a model which simulates a heat transfer phenomenon of the mold whose heat conductivity is high. If α, β, and $T_m$ are given by the later-described profile method, it is possible to form an approximate solution of the solidified shell temperature distribution T and the solidified shell thickness s, and both sufficient accuracy and reduction in a numerical calculation load to simulate the phenomenon are satisfied. A real-time calculation solving the later-described inverse problem is thereby possible owing to this characteristic.

Next, derivation of the approximate solution of the above-stated mathematical model by the profile method is described. The profile method is a method not solving an objected partial differential equation in itself but deriving some conditions satisfied by the solution of the partial differential equation, and finding the solutions satisfying the conditions by providing restrictions on the profile. Specifically, the derivation is performed as described below. At first, the expressions (1) to (5) are transformed while setting ($t_0$, η) as a new variable by a variable transformation from a variable (t, z) by using the expression (9), then α is eliminated by using the expression (6), then the expressions (1) to (5) respectively become the expressions (10) to (14).

[mathematical expression 3]

$$t = t_0 + \eta, z = V_c \cdot \eta \tag{9}$$

$$c_s \cdot \rho_s \cdot \frac{\partial T}{\partial \eta} = \lambda_s \cdot \frac{\partial^2 T}{\partial x^2}, x \in (0, s), \eta \in (0, z_c / V_c), t_0 > -\eta \tag{10}$$

$$\lambda_x \cdot \frac{\partial T}{\partial x} = q_{out}, x = 0, \eta \in (0, z_c / V_c), t_0 > -\eta \tag{11}$$

$$\lambda_s \cdot \frac{\partial T}{\partial x} = \rho_s \cdot L \cdot \frac{\partial s}{\partial \eta} + \beta \cdot (T_0 - T_s), \quad x = s, \eta \in (0, z_c / V_c), t_0 > -\eta \tag{12}$$

$$T = T_s, x = s, \eta \in (0, z_c / V_c), t_0 > -\eta \tag{13}$$

$$s = 0, \eta = 0, t_0 > -\eta \tag{14}$$

A differential of $t_0$ is not appeared in the expressions (10) to (14), and therefore, hereinafter, $t_0$ is treated as a fixed value. Next, a function ψ used for the profile method is defined by the expression (15).

[mathematical expression 4]

$$\Psi = \rho_s \cdot (c_s \cdot T_s + L) \cdot s - \rho_x \cdot c_s \cdot \int_0 T\, dx, \eta \in [0, z_x / V_c] \tag{15}$$

This ψ is differentiated by η, then the expression (16) representing a balance of the heat flux is obtained by using the expressions (10) to (13).

[mathematical expression 5]

$$\frac{\partial \Psi}{\partial \eta} = q_{out} - \beta \cdot (T_0 - T_s),\ \eta \in (0, z_c / V_c) \tag{16}$$

Actually, it is possible to calculate as the expression (17), and therefore, both sides of the expression (15) are differentiated by η and the expression (17) is substituted, then the expression (16) is obtained.

[mathematical expression 6]

$$\begin{aligned}\frac{\partial}{\partial \eta}\int_0^s T\,dx &= T\big|_{x=s} \cdot \frac{\partial s}{\partial \eta} + \int_0^s \frac{\partial T}{\partial \eta}\,dx \\ &= T_s \cdot \frac{\partial s}{\partial \eta} + \int_0^x \frac{\lambda_s}{c_s \cdot \rho_s} \cdot \frac{\partial^2 T}{\partial x^2}\,dx \\ &= T_s \cdot \frac{\partial s}{\partial \eta} + \frac{1}{c_s \cdot \rho_s} \cdot \left(\lambda_s \cdot \frac{\partial T}{\partial x}\Big|_{x=s} - \lambda_s \cdot \frac{\partial T}{\partial x}\Big|_{x=0}\right) \\ &= T_s \cdot \frac{\partial s}{\partial \eta} + \frac{1}{c_s \cdot \rho_s} \cdot \left(\begin{array}{c}\rho_s \cdot L \cdot \frac{\partial s}{\partial \eta} + \\ \beta \cdot (T_0 - T_s) - q_{out}\end{array}\right)\end{aligned} \tag{17}$$

Besides, both sides of the expression (13) are differentiated by η, then the expression (18) is obtained. Besides, if T satisfying both the expression (10) and the expression (13) exists, the equal sign of the expression (10) holds true even at the boundary, and if ∂T/∂η and ∂s/∂η are eliminated from the expression (18) by using the expression (12), the expression (19) is obtained.

[mathematical expression 7]

$$\frac{\partial T}{\partial \eta} + \frac{\partial T}{\partial x} \cdot \frac{\partial s}{\partial \eta} = 0,\ x = s,\ \eta \in (0, z_c / V_c) \tag{18}$$

$$\lambda_s \cdot c_s \left(\frac{\partial T}{\partial x}\right)^2 - c_s \cdot \beta \cdot (T_0 - T_s) \cdot \frac{\partial T}{\partial x} + \lambda_s \cdot L \cdot \frac{\partial^2 T}{\partial x^2} = 0,\quad x = s,\ \eta \in (0, z_c / V_c) \tag{19}$$

As conditions satisfied by the approximate solution by the profile method, the expressions (20) to (26) are employed by summarizing the above.

[mathematical expression 8]

$$\Psi = \rho_s \cdot (c_s \cdot T_s + L) \cdot s - \rho_s \cdot c_s \cdot \int_0^s T\,dx,\ \eta \in [0, z_c / V_c] \tag{20}$$

$$\frac{\partial \Psi}{\partial \eta} = q_{out} - \beta \cdot (T_0 - T_s),\ \eta \in (0, z_c / V_c) \tag{21}$$

$$\lambda_s \cdot \frac{\partial T}{\partial x} = q_{out},\ x = 0,\ \eta \in (0, z_c / V_c) \tag{22}$$

$$q_{out} = \alpha \cdot (T - T_m),\ x = 0,\ \eta \in (0, z_c / V_c) \tag{23}$$

$$\lambda_s \cdot c_s \left(\frac{\partial T}{\partial x}\right)^2 - c_s \cdot \beta \cdot (T_0 - T_s) \cdot \frac{\partial T}{\partial x} + \lambda_s \cdot L \cdot \frac{\partial^2 T}{\partial x^2} = 0,\quad x = s,\ \eta \in (0, z_c / V_c) \tag{24}$$

$$T = T_s,\ x = s,\ \eta \in (0, z_c / V_c) \tag{25}$$

$$s = 0,\ \eta = 0 \tag{26}$$

The profile of T is made quadratic relative to x, and T is given by the expression (27) so as to constantly satisfy the expression (25).

[mathematical expression 9]

$$T = T_s + a \cdot (x - s) + b \cdot (x - s)^2,\ x \in [0, s],\ \eta \in [0, z_c / V_c] \tag{27}$$

Here, a=a(η) and b=b(η) are independent from x, and it is possible to concretely find by substituting the expression (27) into the expressions (22) and (24). Actually, the expression (28) holds true when the expression (27) is differentiated by x, and the expression (22) and the expressions (24) to (29) are obtained, and therefore, the expression (30) and the expression (31) are obtained under a condition of $\partial T/\partial x|_{x=s} > 0$ representing that the heat flux goes from the molten steel side to the solidified shell.

[mathematical expression 10]

$$\frac{\partial T}{\partial x} = a + 2 \cdot b \cdot (x - s),\ \frac{\partial^2 T}{\partial x^2} = 2 \cdot b, \tag{28}$$

$$\lambda_x \cdot (a - 2 \cdot b \cdot s) = q_{out},\quad \lambda_s \cdot c_s \cdot a^2 - c_s \cdot \beta \cdot (T_0 - T_s) \cdot a + 2 \cdot L \cdot \lambda_s \cdot b = 0 \tag{29}$$

$$a = \frac{1}{2 \cdot \lambda_s \cdot c_s}\left(\begin{array}{c} c_s \cdot \beta \cdot (T_0 - T_s) - \frac{L - \lambda_s}{s} + \\ \sqrt{\left\{c_s \cdot \beta \cdot (T_0 - T_x) - \frac{L \cdot \lambda_s}{s}\right\}^2 + \frac{4 \cdot L \cdot q_{out} \cdot \lambda_s \cdot c_s}{s}}\end{array}\right) \tag{30}$$

$$b = \frac{1}{2 \cdot s} \cdot \left(a - \frac{q_{out}}{\lambda_s}\right) \tag{31}$$

Besides, the expression (27) is integrated relative to x to be the expression (32), and therefore, the expression (33) is obtained by substituting the expression (32), the expression (31), and the expression (30) into the expression (20).

[mathematical expression 11]

$$\int_0^s T\,dx = T_s \cdot s - \frac{a}{2} \cdot s^2 + \frac{b}{3} \cdot s^3 \tag{32}$$

$$\Psi = \frac{5}{6} \cdot L \cdot \rho_s \cdot s + \frac{c_s \cdot \rho_s \cdot s^2}{6 \cdot \lambda_s}(q_{out} + \beta \cdot (T_0 - T_s)) + \frac{\rho_s \cdot s}{6 \cdot \lambda_s}\sqrt{(c_s \cdot \beta \cdot (T_0 - T_s) \cdot s - L \cdot \lambda_s)^2 + 4 \cdot L \cdot q_{out} \cdot \lambda_s \cdot c_s \cdot s} \tag{33}$$

On the other hand, when x="0" (zero), the expression (31) and the expression (30) are substituted into the expression (27), the expression (34) is obtained.

[mathematical expression 12]

$$T\big|_{x=0} = T_s - \frac{q_{out} \cdot s}{2 \cdot \lambda_s} - \frac{c_s \cdot \beta \cdot (T_0 - T_s) \cdot s - L \cdot \lambda_s}{4 \cdot \lambda_s \cdot c_s} - \frac{1}{4 \cdot \lambda_s \cdot c_s}\sqrt{\{c_s \cdot \beta \cdot (T_0 - T_s) \cdot s - L \cdot \lambda_s\}^2 + 4 \cdot L \cdot q_{out} \cdot \lambda_s \cdot c_s \cdot s} \tag{34}$$

The expression (23) substituted into the expression (34), then it is simplified by $T|_{x=0} - T_m$ to obtain the expression (35).

[mathematical expression 13]

$$A_2(T|_{x=0}-T_m)^2+A_1(T|_{x=0}-T_m)+A_0=0 \tag{35}$$

Note that $A_2$, $A_1$, and $A_0$ are respectively given by the expression (36), the expression (37), and the expression (38).

[mathematical expression 14]

$$A_2=\left(1+\frac{\alpha\cdot s}{2\cdot\lambda_s}\right)^2 \tag{36}$$

$$A_1=2\cdot\left(1+\frac{\alpha\cdot s}{2\cdot\lambda_s}\right)\cdot\left(\frac{c_s\cdot\beta\cdot(T_0-T_s)\cdot s-L\cdot\lambda_s}{4\cdot\lambda_s\cdot c_s}-T_s+T_m\right)-\frac{L\cdot s\cdot\alpha}{4\cdot\lambda_s\cdot c_s} \tag{37}$$

$$A_0=\left(\frac{c_s\cdot\beta\cdot(T_0-T_s)\cdot s-L\cdot\lambda_s}{4\cdot\lambda_s\cdot c_s}-T_s+T_m\right)^2-\left(\frac{c_s\cdot\beta\cdot(T_0-T_s)\cdot s-L\cdot\lambda_s}{4\cdot\lambda_s\cdot c_s}\right)^2. \tag{38}$$

When s=0 in the expression (34), then $T|_{x=0}=T_s$ is considered, $T|_{x=0}$ given by the expression (39) simultaneously satisfies the expression (34) and the expression (23) between two solutions of the expression (35) relating to $T|_{x=0}$.

[mathematical expression 15]

$$T|_{x=0}=T_m+\frac{1}{2\cdot A_2}\left(-A_1-\sqrt{A_1^2-4\cdot A_2\cdot A_0}\right) \tag{39}$$

In summary, the approximate solution by the profile method satisfies the expressions (40) to (44).

[mathematical expression 16]

$$s=0,\ \eta=0 \tag{40}$$

$$T|_{x=0}=T_m+\frac{1}{2\cdot A_2}\left(-A_1-\sqrt{A_1^2-4\cdot A_2\cdot A_0}\right),\ \eta\in(0,z_c/V_c) \tag{41}$$

$$q_{out}=\alpha\cdot(T|_{x=0}-T_m),\ \eta\in(0,z_c/V_c) \tag{42}$$

$$\frac{\partial\Psi}{\partial\eta}=q_{out}-\beta\cdot(T_0-T_s),\ \eta\in(0,z_c/V_c) \tag{43}$$

$$\Psi=\frac{5}{6}\cdot L\cdot\rho_s\cdot s+\frac{c_s\cdot\rho_s\cdot s^2}{6\cdot\lambda_s}(q_{out}+\beta\cdot(T_0-T_s))+\frac{\rho_s\cdot s}{6\cdot\lambda_s}\sqrt{(c_s\cdot\beta\cdot(T_0-T_s)\cdot s-L\cdot\lambda_s)^2+4\cdot L\cdot q_{out}\cdot\lambda_s\cdot c_s\cdot s},\ \eta\in[0,z_c/V_c] \tag{44}$$

Note that $A_2$, $A_1$, and $A_0$ in the expression (41) are respectively given by the expressions (36) to (38). Processes until the derivation of the expressions (40) to (44) are an equation construction step. Besides, if it is possible to construct s satisfying the expressions (40) to (44), $q_{out}$ can be found from the expression (42), then T is defined by the expression (27) from the expressions (30) and (31), and it turns out that the expressions (20) to (26) are satisfied. Accordingly, if s satisfying the expressions (40) to (44) can be found, the approximate solution by the profile method is constructed, but this can be numerically obtained by differentiating the expression (43). Specifically, it goes as stated below. Setting $c_s$, $\rho_s$, $\lambda_s$, L, $T_0$, $T_s$ as known constants, and regarding η, calculation points are set to $\eta_0=0$, $\eta_i=\eta_{i-1}+d\eta$ ($d\eta>0$, i=1, 2, . . . , n), $\eta_n=z_e/V_c$. When α, β, and $T_m$ are given by $\eta=\eta_i$, they are respectively set to $\alpha_i$, $\beta_i$, and $T_{m,i}$. The expression (43) is differentiated by Euler method, and an approximate value of $\psi(\eta_i)$ is represented by $\psi_i$, it becomes as represented by the expression (45).

[mathematical expression 17]

$$\Psi_{i+1}=\Psi_i+d\eta\cdot\{q_{out}-\beta_i\cdot(T_0-T_s)\},i=0,1,\ldots,n-1 \tag{45}$$

Then, an approximate value $s_i$ of $s(\eta_i)$ can be recursively calculated as illustrated below. At first, $s_0=0$ from the expression (40), and $\psi_0=0$ from the expression (44). Next, when $s_i$ and $\psi_i$ are given, $\alpha_i$, $\beta_i$, and $T_{m,i}$, and $s_i$ are respectively substituted into α, β, $T_{m,i}$, and $s_i$ in the expressions (36) to (38). Then, $T|_{x=0}$ is found from the expression (41), $q_{out}$ is found from the expression (42), and $\psi_{i+1}$ is found from the expression (45). Next, $\psi_{i+1}$ and $\beta_{i+1}$ are substituted into ψ and β in the expression (44), $q_{out}$ obtained by the expression (42) is substituted into $q_{out}$ to solve as for s to be $s_{i+1}$. It is thereby possible to find $s_{i+1}$ and $\psi_{i+1}$ from $s_i$ and $\psi_i$, so it is possible to recursively define $s_i$.

Hereinabove, it is described that T and s are able to be found by using the profile method while setting $t_0$ as an arbitrary time, on $t=t_0+\eta$, $z=V_c\cdot\eta$ for $\eta\in[0, z_e/V_c]$ when $c_s$, $\rho_s$, $\lambda_s$, L, $T_0$, $T_s$ $V_c$ are already known, and α, β, $T_m$ are given. Hereinafter, T and s obtained by the above-stated profile method are represented by the expression (46) because T and s depend on α, β, and $T_m$.

[mathematical expression 18]

$$T_{prof}(\alpha,\beta,T_m)\text{ and }s_{prof}(\alpha,\beta,T_m) \tag{46}$$

Next, formulation as an inverse problem and a solution thereof are described. The inverse problem is a generic of a problem estimating a cause from a result. Within a frame of the mathematical model representing the solidification heat-transfer phenomenon in the mold, it is possible to immediately calculate the expression (47) and the expression (48) being the mold surface temperature and the heat flux passing through the mold from the expression (7) and the expression (8) when $\lambda_m$, $d_1$, $d_2$, $h_w$, $c_s$, $\rho_s$, $\lambda_s$, L, $T_0$, $T_s$, $T_w$, and $V_C$ are set to be already known, and $t_0=t_1-z_1/V_c$ at ($t_1$, $z_1$) where $t_1-z_1/V_c$ is during the casting time for $z_1\in(0, z_e)$, and when $T_c$ where the measurement values by the thermocouples 6 embedded in the mold 4 for $\eta\in(0, z_1/V_c)$ are interpolated on $t=t_0+\eta$, $z=V_c\cdot\eta$ is obtained.

[mathematical expression 19]

$$T_m=T_c+\frac{d_1}{\lambda_m}\cdot\frac{1}{\frac{1}{h_w}+\frac{d_2}{\lambda_m}}\cdot(T_c-T_w),\ \eta\in(0,z_1/V_c) \tag{47}$$

$$q_{out}=\frac{1}{\frac{1}{h_w}+\frac{d_2}{\lambda_m}}\cdot(T_c-T_w),\ \eta\in(0,z_1/V_c) \tag{48}$$

On the other hand, the heat flux passing through the mold flux layer 3 is represented by the expression (49) from the expression (6) and the expression (7).

[mathematical expression 20]

$$q_{out} = \frac{1}{\frac{1}{\alpha} + \frac{d_1}{\lambda_m}} \cdot (T_{prof}(\alpha, \beta, T_m)|_{x=0} - T_c), \eta \in (0, z_1/V_c) \tag{49}$$

Accordingly, a problem estimating α and β such that the expression (49) holds true for $q_{out}$ given by the expression (48) is the inverse problem in the solidification heat-transfer phenomenon in the mold. This inverse problem is resolved to solve a minimization problem by a least squares method represented by the expression (50) for $q_{out}$ given by the expression (48).

[mathematical expression 21]

$$\min_{\substack{\alpha=(\alpha_0,\ldots,\alpha_n),\\ \beta=(\beta_0,\ldots,\beta_n),\\ \alpha_i>0,\beta_i>0}} \sum_{i=1}^{n} \left| q_{out}|_{\eta=\eta_i} - \frac{1}{\frac{1}{\alpha_i} + \frac{d_1}{\lambda_m}} \cdot (T_{prof}(\alpha, \beta, T_m)|_{x=0} - T_c)|_{\eta=\eta_i} \right|^2 \tag{50}$$

Here, $\eta_0=0$, $\eta_i=\eta_{i-1}+d\eta$ ($d\eta>0$, i=1, 2, . . . , n), $\eta_n=z_1/V_c$, and as stated above, it is possible to numerically calculate $T_{prof}$ (α, β, and $T_m$), therefore, the minimization problem is able to be solved by a general numerical solution using a Gauss-Newton method or the like. It is a heat transfer coefficient estimation step to solve the minimization problem of the expression (50), and the solidified shell thickness, and the solidified shell temperature are obtained by substituting α, β, and $T_m$ decided at each time, each position (t, z) into the expression (46). It is therefore possible to obtain the heat transfer coefficient α, the heat transfer coefficient β, the solidified shell thickness s, and the solidified shell temperature T being the solidified state in mold estimation amounts at (t, z). These solidified state in mold estimation amounts are hereinafter respectively represented as $\alpha_{est}$ (t, z), $\beta_{est}$ (t, z), $s_{est}$ (t, z), and $T_{est}$ (t, z, x)

Hereinabove is the estimation method of the state in the mold described in Patent Literature 2.

[Decision Method of Allowable Limit Values]

Next, a decision method of concrete allowable limit values to determine signs of the abnormal casting is described before the inverse problem method estimating the state in the mold is applied to an early detection method of the break-out due to drift being the abnormal casting.

At first, the mold temperatures or the like during casting are stored in advance. At that time, the casting speed, a super-heat being a difference between a molten steel temperature and a solidification temperature, a casting width being casting conditions are also stored as time-series data. The continuous casting equipment where the present invention can be applied is a continuous casting equipment where the abnormal casting has occurred, and temperature information or the like measured when the abnormal casting occurred has been stored.

Next, calculation expressions to be the solidified state in mold evaluation amounts are prepared. Ones which can be the solidified state in mold evaluation amounts are ones using the solidified state in mold estimation amounts which change caused by drifting of the flow of the molten steel, and it becomes "0" (zero) if the drift does not occur, and becomes a positive or negative value in accordance with a direction and a size of the drift when the drift occurs. For example, evaluation values defined by the following expression (51), expression (52), expression (53), or expression (54) become the solidified state in mold evaluation amounts.

[mathematical expression 22]

$$\operatorname*{mean}_{t-(m-1)\cdot\delta t\le\tau\le t} (s_{estL} - s_{estR})(\tau, z) = \frac{1}{m} \cdot \sum_{j=1}^{m} (s_{estL}(t-(j-1)\cdot\delta t, z) - s_{estR}(t-(j-1)\cdot\delta t, z)) \tag{51}$$

$$\operatorname*{mean}_{t-(m-1)\cdot\delta t\le\tau\le t} (\beta_{estL} - \beta_{estR})(\tau, z) = \frac{1}{m} \cdot \sum_{j=1}^{m} (\beta_{estL}(t-(j-1)\cdot\delta t, z) - \beta_{estR}(t-(j-1)\cdot\delta t, z)) \tag{52}$$

$$\operatorname*{sgnmin}_{t-(m-1)\cdot\delta t\le\tau\le t} |(s_{estL} - s_{estR})(\tau, z)| = \operatorname{sgn}\left(\operatorname*{mean}_{t-(m-1)\cdot\delta t\le\tau\le t} (s_{estL} - s_{estR})(\tau, z)\right) \min_{t-(m-1)\cdot\delta t\le\tau\le t} |(s_{estL} - s_{estR})(\tau, z)| \tag{53}$$

$$\operatorname*{sgnmin}_{t-(m-1)\cdot\delta t\le\tau\le t} |(\beta_{estL} - \beta_{estR})(\tau, z)| = \operatorname{sgn}\left(\operatorname*{mean}_{t-(m-1)\cdot\delta t\le\tau\le t} (\beta_{estL} - \beta_{estR})(\tau, z)\right) \min_{t-(m-1)\cdot\delta t\le\tau\le t} |(\beta_{estL} - \beta_{estR})(\tau, z)| \tag{54}$$

Here, $s_{estL}$ (t, z), $s_{estR}$ (t, z), $\beta_{estL}$ (t, z), and $\beta_{estR}$ (t, z) respectively represent the solidified shell estimated thicknesses and the heat transfer coefficients β being the solidified state in mold estimation amounts at short sides of two planes by using subscripts L, R distinguishing right and left short sides. Besides, δt is a sampling cycle, m·δt is an evaluation time, and sgn is a sign of a number. The expression (51) and the expression (52) are moving average values of past m·δt, and the expression (53) and the expression (54) are ones where a minimum value of the past m·δt regarding an absolute value of a difference of state quantities is multiplied by a sign representing the direction of the drift. There are flexibilities in an evaluation time m and an evaluation position z in the solidified state in mold evaluation amounts, and therefore, one solidified state in mold evaluation amount is obtained every time when one combination of m and z is specified. In the solidified state in mold evaluation amounts as stated above, it is necessary to discretely select a plurality of representative m and z to select a best casting state determination amount for an objected continuous casting equipment.

Next, an allowable limit value examination period is provided in advance, the solidified state in mold estimation amounts are found from the measurement data during the allowable limit value examination period, and candidates of the solidified state in mold evaluation amounts are also calculated and stored. The casting conditions are classified by layers while defining a grade width regarded to be the same, and respective layers are represented by $G_1$, . . . $G_N$. The solidified state in mold evaluation amounts are also classified by layers in accordance with $G_k$, and an average value $\mu_k$ and a standard deviation $\sigma_k$ are calculated by each of the solidified state in mold evaluation amounts classified by layers. Here, k=1, N each represent a subscript of each classified layer, and N is a total number of layers. It is desirable that the allowable limit value examination period is set to be long enough such that a statistic calculated from the casting condition $G_k$ classified by layers can be estimated with allowable accuracy. Besides, the solidified state in mold estimation amounts and the solidified state in mold evaluation amounts are classified by layers in accordance with classifications for the casting conditions and the measurement values set in advance. The casting conditions and the measurement values are one or more kinds from among the casting speed, the casting width, the molten steel temperature, the difference between the molten steel temperature and the liquidus temperature, and the difference between the molten steel temperature and the solidus temperature.

Next, the solidified state in mold estimation amounts are found by solving the inverse problem from the measurement data of the break-out due to drift being the abnormal casting occurred in the past, the solidified state in mold evaluation amounts are calculated, and one whose solidified state in mold evaluation amount just before the break-out occurrence is the most separated from a normal time is selected as a casting state determination amount. A value of the solidified state in mold evaluation amount just before the occurrence of the break-out due to drift being the abnormal casting is represented by E, then the casting state determination amount is set by selecting the solidified state in mold evaluation amount where a value given by the expression (55) becomes a maximum relative to $\mu_k$ and $\sigma_k$ of the solidified state in mold evaluation amounts of the layer where the casting condition at the break-out occurrence time belongs.

[mathematical expression 23]

$$|E-\mu_k|/\sigma_k \tag{55}$$

Which solidified state in mold evaluation amount is able to sense the drift with high sensitivity depends on the continuous casting equipment, and therefore, it is necessary to select the solidified state in mold evaluation amount in accordance with a casting machine. A positive constant to adjust the allowable limit value for the selected casting state determination amount is represented by A, a total sum of time satisfying the expression (56) under each casting condition $G_k$ is calculated, and a ratio for the allowable limit value examination period is found.

[mathematical expression 24]

$$|\text{casting state determination amount}-\mu_k|>A\cdot\sigma_k \tag{56}$$

This ratio corresponds to a ratio where the normal casting is misjudged to be the casting where the break-out due to drift occurs, and the ratio decreases if A is set large. It is thereby possible to detect the casting failure leading to the break-out due to drift being the abnormal casting with high accuracy as long as the positive constant A where the above-stated ratio is allowable, and the expression (56) is satisfied in the past abnormal casting is selected. It is a decision method of the allowable limit values to set the allowable limit values associated with each casting condition $G_k$ at $\mu_k \pm A\cdot\sigma_k$ for the selected A. Namely, a value where one time or more value of the standard deviation $\sigma_k$ is added to the average value $\mu_k$ and a value where one time or more value of the standard deviation $\sigma_k$ is subtracted from the average value $\mu_k$ are used as the allowable limit values.

When the allowable limit values are actually applied, the average value $\mu_k$ and the standard deviation $\sigma_k$ of the solidified state in mold evaluation amounts corresponding to $G_k$ where the current casting conditions belong are taken out, then it is determined as a normal casting state when the casting state determination amount found by actual measurement satisfies the expression (57), and it is determined as an abnormal casting state where there is a high risk of the occurrence of the break-out due to drift if the expression (57) is not satisfied. This is the determination method of the casting state.

[mathematical expression 25]

$$\mu_k-A\cdot\sigma_k<\text{casting state determination amount}<\mu_k+A\cdot\sigma_k \tag{57}$$

Figure 1:
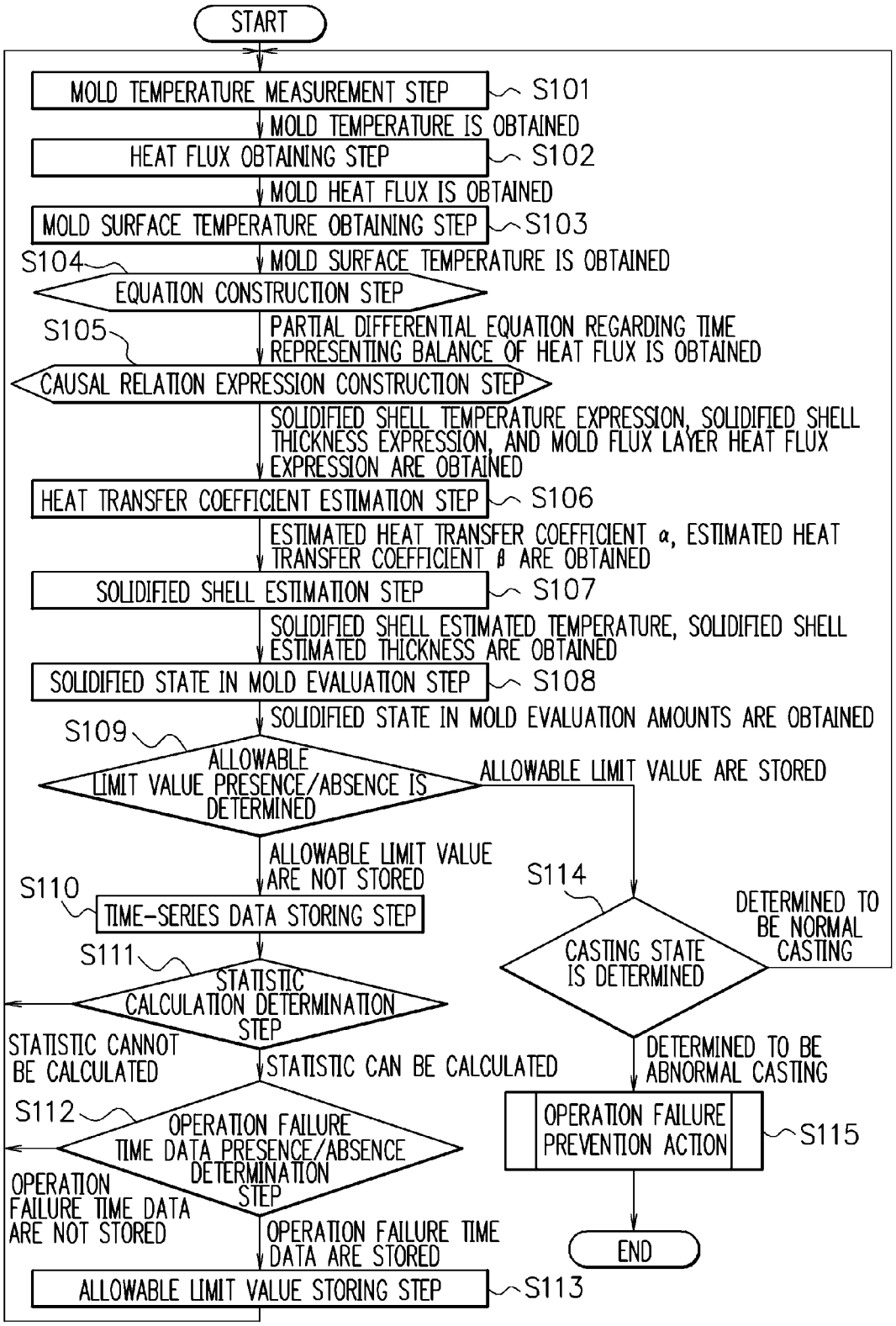
FIG. 1 is a flowchart illustrating a determination method of a casting state according to an embodiment.

Hereinafter, the determination method of the casting state according to the present embodiment is described by using a flowchart illustrated in FIG. 1.

At first, the mold heat conductivity $\lambda_m$, the thermocouple embedded depth from the mold surface $d_1$, the distance from the thermocouple 6 to the cooling water 5 $d_2$, the heat transfer coefficient between the mold and the cooling water $h_w$, the solidified shell specific heat c the solidified shell density $\rho_s$, the solidified shell heat conductivity $\lambda_s$, the solidification latent heat L, and the solidified temperature $T_s$ each of which are able to be known in advance are set to be already known regarding a size and physical property values of the mold 4, and physical property values of the molten steel 1 to be a casting object when the casting is performed. As for the molten steel temperature $T_0$, the cooling water temperature $T_w$, and the casting speed $V_c$ which may change during casting, it is possible to set them to be already known by using average values, but it is desirable to measure them in step S101 as same as the mold temperature $T_c$.

In a mold temperature measurement step of the step S101, the mold temperature $T_c$ at the thermocouple embedded depth position is found by measuring and interpolating the mold temperature, the temperature distribution in the casting direction is found, and they are stored in a data storage part in time-series.

In a heat flux obtaining step of step S102, the heat flux $q_{out}$ passing through the mold 4 is found from the mold temperature $T_c$ obtained in the step S101 by using the expression (48).

In a mold surface temperature obtaining step of step S103, the mold surface temperature $T_m$ is found from the mold temperature $T_c$ obtained in the step S101 by using the expression (47).

In an equation construction step of step S104, the partial differential equation being a partial differential equation which contains at least the heat transfer coefficient α, the heat transfer coefficient β, the solidified shell thickness s, and the solidified shell temperature T represented by the expressions (40) to (44), and regarding a time representing a balance of the heat flux at the solidified shell 2 is constructed as a preparation for a causal relation expression construction step of step S105.

In the causal relation expression construction step of the step S105, the partial differential equation constructed in the step S104 is solved, then there are constructed: a solidified shell temperature expression being a relational expression of the solidified shell temperature relative to the heat transfer coefficient α, the heat transfer coefficient β, and the mold surface temperature which are represented by the expression (46) and the expression (49); a solidified shell thickness expression being a relational expression of the solidified shell thickness relative to the heat transfer coefficient α, the heat transfer coefficient β, and the mold surface temperature; and a mold flux layer heat flux expression being a relational expression of the mold flux layer heat flux relative to the heat transfer coefficient α, the heat transfer coefficient β, and the mold surface temperature as the causal relation expression, as a preparation for a heat transfer coefficient estimation step of step S106.

In the heat transfer coefficient estimation step of the step S106, the mold surface temperature $T_m$ obtained in the step S103 is applied to the mold flux layer heat flux expression obtained in the step S105, the minimization problem of the expression (50) being the inverse problem simultaneously deciding a distribution of the heat transfer coefficient $\alpha$ in the casting direction and a distribution of the heat transfer coefficient $\beta$ in the casting direction is solved such that a total sum of values at a plurality of points becomes the minimum regarding a distribution in the casting direction of a square value where the mold heat flux $q_{out}$ obtained in the step S102 is subtracted from the mold flux layer heat flux expression, to thereby simultaneously decide the heat transfer coefficient $\alpha$ and the heat transfer coefficient $\beta$.

In a solidified shell estimation step of step S107, the solidified shell estimated temperature and the solidified shell estimated thickness are decided by applying the mold surface temperature $T_m$ obtained in the step S103, the heat transfer coefficient $\alpha$ and the heat transfer coefficient $\beta$ obtained in the step S106 to the solidified shell temperature expression and the solidified shell thickness expression obtained in the step S105, namely, $T_{prof}(\alpha, \beta, T_m)$ and $s_{prof}(\alpha, \beta, T_m)$ in the expression (46).

In a solidified state in mold evaluation step of step S108, the solidified state in mold evaluation amounts are calculated in response to a calculation method defined in advance from the heat transfer coefficient $\alpha$ and the heat transfer coefficient $\beta$ obtained in the step S106 and the solidified shell estimated temperature and the solidified shell estimated thickness obtained in the step S107. Namely, the heat transfer coefficient $\alpha$, the heat transfer coefficient $\beta$ obtained in the step S106 and the solidified shell estimated thickness, the solidified shell estimated temperature obtained in the step S107 are called as the solidified state in mold estimation amounts, and there are decided the solidified state in mold evaluation amounts being the amounts obtained by applying the calculation method defined in advance to at least one or a plurality of the solidified state in mold estimation amounts.

In an allowable limit value presence/absence determination step of step S109, it is determined whether or not the allowable limit values found in an allowable limit value storing step of step S113 are stored in a data storage part. When the allowable limit values are not stored, the process goes to a time-series data storing step of step S110 being a preparation step to find the allowable limit values, and when the allowable limit values are stored, the process goes to step S114 to determine the casting state.

In the time-series data storing step of the step S110, at least one or more kinds of amounts contained in the solidified state in mold estimation amounts and the solidified state in mold evaluation amounts defined in the step S108 are stored in the data storage part as a time-series data together with information indicating whether or not the abnormal casting occurred to calculate a statistic.

In a statistic calculation determination step of step S111, it is determined whether or not the time-series data stored in the step S110 are accumulated for a period defined in advance, and it is possible to calculate the statistic including the average and the standard deviation of the time-series data. If the statistic of the time-series data cannot be calculated, the process returns to the mold temperature measurement step of the step S101 to increase the number of data, and the measurement is newly performed again. If the statistic of the time-series data can be calculated, the process goes to an operation failure time data presence/absence determination step of step S112.

In the operation failure time data presence/absence determination step of the step S112, it is determined whether or not at least one or more kinds of amounts contained in the solidified state in mold estimation amounts and the solidified state in mold evaluation amounts when the abnormal casting occurred are stored in the data storage part. If they are stored, the process goes to the allowable limit value storing step of the step S113 being the step to define the allowable limit values, and if they are not stored, the process returns to the mold temperature measurement step of the step S101, and the measurement is newly performed again.

In the allowable limit value storing step of the step S113, the casting state determination amount being an amount used for the determination of the casting state is selected from the stored time-series data by using the time-series data when the abnormal casting occurred, and the statistic information including the average and the standard deviation of the time-series data obtained in the step S110, the allowable limit values defining a range of data regarded to be the normal casting state are decided as for the casting state determination amount, and stores the allowable limit values in the data storage part. After the allowable limit values are decided and stored in the data storage part, the process returns to the mold temperature measurement step of the step S101, and the measurement is newly performed again.

On the other hand, in a casting state determination step of the step S114, the allowable limit values are compared with the amount which is selected as the casting state determination amount in the step S113 from among the solidified state in mold estimation amounts obtained in the steps S106, S107 and the solidified state in mold evaluation amounts obtained in the step S108. If it is determined to be the normal casting state, the process returns to the mold temperature measurement step of the step S101, and the measurement is newly performed again. If it is determined to be the abnormal casting state, the process goes to step S115.

In the step S115, an operation action such that, for example, the casting speed is lowered is performed so as to prevent the operation failure resulting from the abnormal casting state. The operation actions to be performed are set in advance.

As stated above, the heat transfer coefficient $\alpha$ being the heat flux per a unit temperature difference between the solidified shell 2 and the mold 4 sandwiching the mold flux layer 3, and the heat transfer coefficient $\beta$ between the molten steel 1 and the solidified shell 2 are found by solving the inverse problem, the solidified shell thickness s and the solidified shell temperature T distribution of the solidified shell 2 are estimated from the heat transfer coefficient $\alpha$ and the heat transfer coefficient $\beta$, and it is determined whether the normal casting state or the abnormal casting state by using the estimated results.

Figure 8:
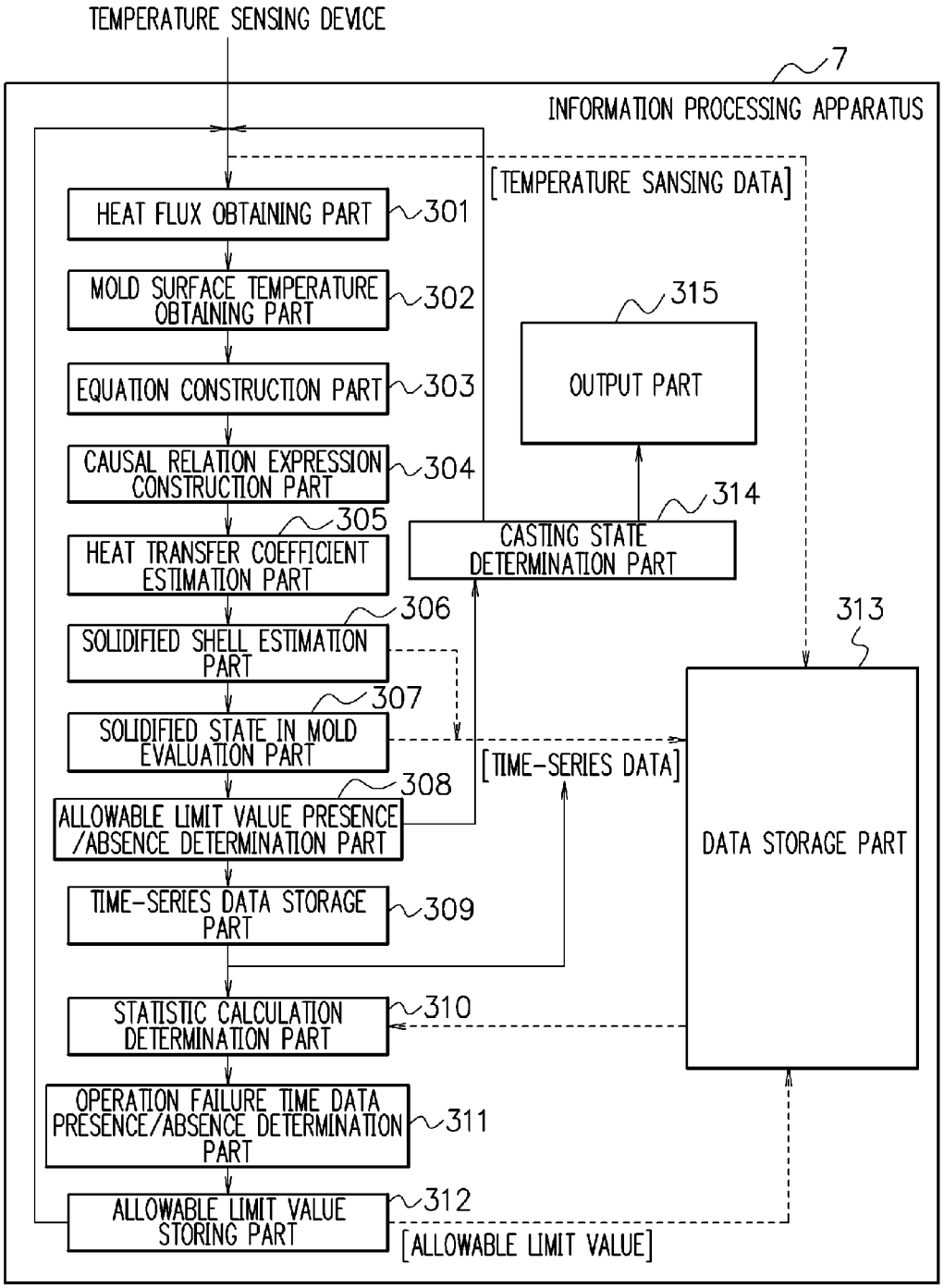
FIG. 8 is a block diagram illustrating a configuration of the information processing apparatus functioning as a determination apparatus of the casting state according to the embodiment.

A configuration of the information processing apparatus 7 functioning as a determination apparatus of the casting state is illustrated in FIG. 8.

The temperature measurement results of the mold 4 by using the thermocouples 6 during the continuous casting are input to the information processing apparatus 7, the temperature distribution in the casting direction at the thermocouple embedded depth positions which is obtained by interpolating the mold temperatures is stored in a data storage part 313 in time series, and the data is transmitted to a heat flux obtaining part 301.

At the heat flux obtaining part 301, the heat flux $q_{out}$ passing through the mold 4 is found from the mold temperature $T_c$ by using the expression (48).

At a mold surface temperature obtaining part 302, the mold surface temperature $T_m$ is found from the mold temperature $T_c$ by using the expression (47).

At an equation construction part 303, a partial differential equation being a partial differential equation which contains at least the heat transfer coefficient α, the heat transfer coefficient β, the solidified shell thickness s, and the solidified shell temperature T represented by the expressions (40) to (44), and regarding the time representing the balance of the heat flux at the solidified shell 2 is constructed as a preparation for a process by a causal relation expression construction part 304.

At the causal relation expression construction part 304, the partial differential equation constructed at the equation construction part 303 is solved, then there are constructed: the solidified shell temperature expression being the relational expression of the solidified shell temperature relative to the heat transfer coefficient α, the heat transfer coefficient β, and the mold surface temperature represented by the expression (46) and the expression (49); the solidified shell thickness expression being the relational expression of the solidified shell thickness relative to the heat transfer coefficient α, the heat transfer coefficient β, and the mold surface temperature; and the mold flux layer heat flux expression being the relational expression of the mold flux layer heat flux relative to the heat transfer coefficient α, the heat transfer coefficient β, and the mold surface temperature as the causal relation expression as a preparation for a process by a heat transfer coefficient estimation part 305.

At the heat transfer coefficient estimation part 305, the heat transfer coefficient α and the heat transfer coefficient β are simultaneously decided by applying the mold surface temperature $T_m$ obtained by the mold surface temperature obtaining part 302 to the mold flux layer heat flux expression obtained at the causal relation expression construction part 304, and solving the minimization problem of the expression (50) being the inverse problem simultaneously deciding the distribution of the heat transfer coefficient α in the casting direction and the distribution of the heat transfer coefficient β in the casting direction such that the total sum of the values at the plurality of points becomes the minimum regarding the distribution in the casting direction of the square value of the value where the mold heat flux $q_{out}$ obtained at the heat flux obtaining part 301 is subtracted from the mold flux layer heat flux expression.

At a solidified shell estimation part 306, the solidified shell estimated temperature and the solidified shell estimated thickness are decided by applying the mold surface temperature $T_m$ obtained at the mold surface temperature obtaining part 302, the heat transfer coefficient α and the heat transfer coefficient β obtained at the heat transfer coefficient estimation part 305 to the solidified shell temperature expression and the solidified shell thickness expression obtained at the causal relation expression construction part 304, namely $T_{prof}$ (α, β, $T_m$) and $s_{prof}$ (α, β, $T_m$) in the expression (46).

At a solidified state in mold evaluation part 307, the solidified state in mold evaluation amounts are calculated in response to the calculation method defined in advance from the heat transfer coefficient α and the heat transfer coefficient β obtained at the heat transfer coefficient estimation part 305, the solidified shell estimated temperature and the solidified shell estimated thickness obtained at the solidified shell estimation part 306. Namely, the heat transfer coefficient α and the heat transfer coefficient β obtained at the heat transfer coefficient estimation part 305, the solidified shell estimated temperature and the solidified shell estimated thickness obtained at the solidified shell estimation part 306 are called as the solidified state in mold estimation amounts, and the solidified state in mold evaluation amounts being the amounts obtained by applying the calculation method defined in advance to at least one or a plurality of the solidified state in mold estimation amounts are decided.

At an allowable limit value presence/absence determination part 308, it is determined whether or not the allowable limit values found at an allowable limit value storage part 312 are stored in the data storage part 313. If the allowable limit values are not stored, the process is performed by a time-series data storage part 309 as a preparation to find the allowable limit values, and if the allowable limit values are stored, the process is performed by a casting state determination part 314.

At the time-series data storage part 309, at least one or more kinds of amounts contained in the solidified state in mold estimation amounts and the solidified state in mold evaluation amounts defined at the solidified state in mold evaluation part 307 are stored as the time-series data in the data storage part 313 together with the information whether or not the abnormal casting occurred to calculate the statistic.

At a statistic calculation determination part 310, it is determined whether or not the time-series data stored at the time-series data storage part 309 are accumulated for the period defined in advance, and the statistic including the average and the standard deviation of the time-series data can be calculated. If the statistic of the time-series data cannot be calculated, the mold temperature is newly measured again to increase the number of data. If the statistic of the time-series data can be calculated, the process is performed by an operation failure time data presence/absence determination part 311.

At the operation failure time data presence/absence determination part 311, it is determined whether or not at least one or more kinds of amounts contained in the solidified state in mold estimation amounts and the solidified state in mold evaluation amounts when the abnormal casting occurred are stored in the data storage part 313. If they are stored, the process is performed by the allowable limit value storage part 312 which defines the allowable limit values, and if they are not stored, the mold temperature is newly measured again.

At the allowable limit value storage part 312, the casting state determination amount being the amount used for the determination of the casting state is selected from the data stored as the time-series data by using the time-series data when abnormality occurred in the casting state, the statistic information including the average and the standard deviation of the time-series data obtained at the time-series data storage part 309, the allowable limit values defining a data range regarded as the normal casting state are decided as for the casting state determination amount, and they are stored in the data storage part 313. After the allowable limit values are decided and stored in the data storage part 313, the mold temperature is newly measured again.

At a casting state determination part 314, the allowable limit values are compared with the amount selected as the casting state determination amount at the allowable limit value storage part 312 from among the solidified state in mold estimation amounts obtained at the heat transfer coefficient estimation part 305 and the solidified shell estimation part 306, and the solidified state in mold evaluation amounts obtained at the solidified state in mold evaluation part 307. If it is determined as the normal casting state, the mold temperature is newly measured again. Then the result determining either the normal casting state or the abnormal casting state is output from an output part 315.

Note that the present invention is able to be enabled by a computer executing a program. Besides, a computer readable recording medium recording this program and a computer program product such as the program are also applied as the present invention. As the recording medium, it is possible to use, for example, a flexible disk, a hard disk, an optical disk, a magneto-optical disk, a CD-ROM, a magnetic tape, a non-volatile memory card, a ROM, and so on.

Further, the above-described embodiment merely illustrates, in its entirety, an example of implementing the present invention, and therefore the technical scope of the present invention should not be construed in any restrictive sense by the embodiment. That is, the invention may be embodied in various forms without departing from the spirit or essential characteristics thereof.

EXAMPLES

Next, examples where the present invention is applied are described.

Example 1

The present example evaluates influence of the embedding positions of the thermocouples being the temperature sensing units in the mold exerted on estimation accuracy when the estimation of the solidified state in the mold is performed by using the method of the present invention.

A mold with a length of 1090 mm is used, a molten steel surface level is controlled to be at a position of 85 mm from an upper end of the mold being a supposed surface level position, and the continuous casting is performed while setting the casting speed at 1.7 m/min. The thermocouples are used as the temperature sensing units, the embedding positions of the thermocouples are set at 20 mm intervals from 15 mm to 255 mm under the molten steel surface level, in addition, one point is provided at 755 mm under the molten steel surface level (at 250 mm from a lower end of the mold) to collect temperature data during casting. Here, the embedding position of the thermocouple into the mold is represented by a distance from the molten steel surface level. The collection of the temperature data is performed while setting a sampling interval to one second. One thermocouple used for the estimation of the heat transfer coefficient β and the solidified shell thickness s is selected from among the plurality of thermocouples, and the evaluation of the estimation accuracy is performed from estimation results obtained by different selection ways in nine levels.

The embedding positions of the thermocouples used for the estimation of β and s, the estimation accuracy evaluations of β and s, and a comprehensive evaluation in each level are illustrated in Table 1 As for the embedding positions of the thermocouples, o is written for ones used for the estimation of β and s. Among the nine levels, the most thermocouples are used in the level "0" (zero), and it is conceivable that β and a are estimated with the highest accuracy. The estimation results of the level "0" (zero) are therefore set as a reference, and relative differences of the estimation results of β and s in each level are Set as estimation accuracy evaluation indexes. Namely, the estimations of β and s at the same one minute time zone are performed in each level, time averages are calculated regarding the estimation values of β and a at each estimation position disposed in the casting direction, and a root-mean-square at all estimation positions of the relative differences for the level "0" (zero) of the time average of the estimation values of β and s are set as indexes. As a result, the comprehensive evaluation is set to o as good estimation accuracy when the relative differences of β and s are both 10% or leas, and the others are set to Δ.

TABLE 1

| | EMBEDDING POSITION OF THERMOCOUPLE (DISTANCE FROM MOLTEN STEEL SURFACE LEVEL) [mm] | | | | | | | | | | | | | | β RELATIVE | s RELATIVE | COMPREHENSIVE |
|---|---|---|---|---|---|---|---|---|---|---|---|---|---|---|---|---|---|
| LEVEL | 15 | 35 | 55 | 75 | 95 | 115 | 135 | 155 | 175 | 195 | 215 | 235 | 255 | 755 | DIFFERENCE | DIFFERENCE | EVALUATION |
| 0 | o | o | o | o | o | o | o | o | o | o | o | o | o | o | 0% | 0% | o |
| 1 | o | — | o | — | o | — | o | — | o | — | o | — | o | o | 1% | 2% | o |
| 2 | o | — | — | o | — | — | o | — | — | o | — | — | o | o | 2% | 3% | o |
| 3 | o | — | — | — | — | — | o | — | — | — | — | — | o | o | 7% | 6% | o |
| 4 | o | — | — | — | — | — | — | — | — | — | — | — | o | o | 21% | 11% | Δ |
| 5 | — | — | — | — | o | o | o | o | o | o | o | o | o | o | 10% | 5% | o |
| 6 | — | — | — | — | — | o | o | o | o | o | o | o | o | o | 13% | 6% | Δ |
| 7 | — | — | — | — | — | — | — | — | — | — | o | o | o | o | 20% | 9% | Δ |
| 8 | o | o | o | o | o | o | o | o | o | o | o | o | o | — | 24% | 4% | Δ |

Figure 9:
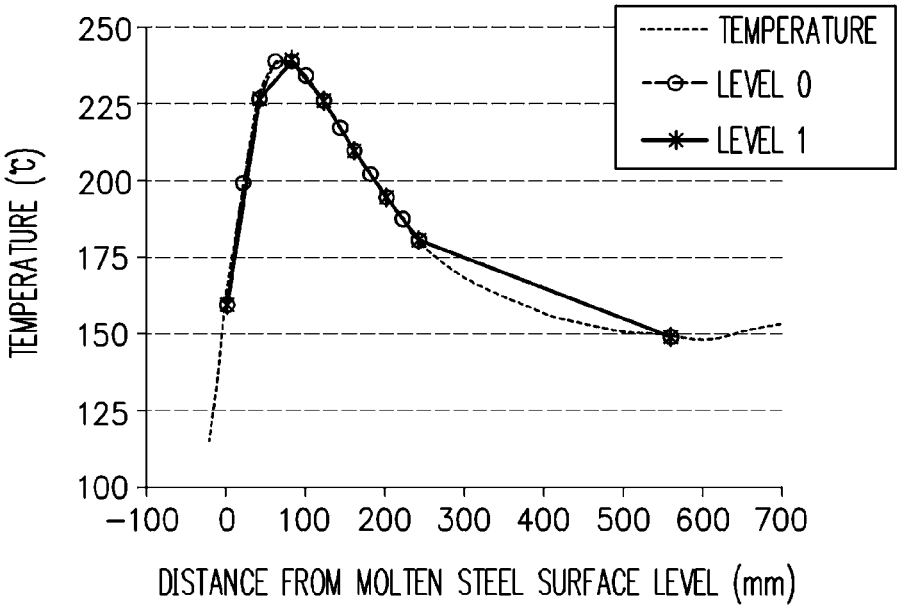
FIG. 9 is a characteristic chart illustrating a mold temperature distribution which is linearly interpolated according to an example 1.
Figure 10:
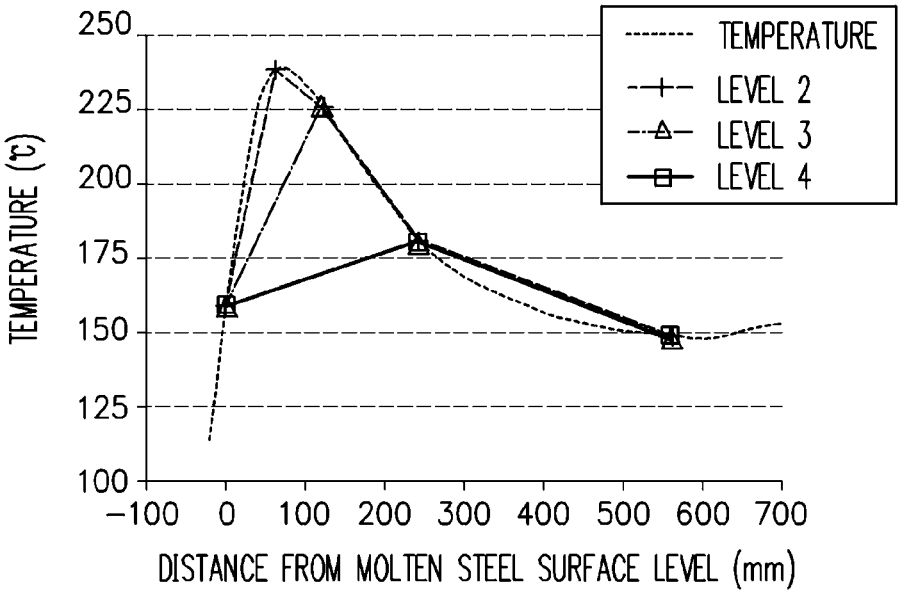
FIG. 10 is a characteristic chart illustrating the mold temperature distribution which is linearly interpolated according to the example 1.

From the level "0" (zero) to the level 4, the solidified state in mold estimation was performed by selecting the thermocouples within a range from 15 mm to 255 mm under the molten steel surface level at an upper side of the mold, and selecting also the thermocouple at 755 mm under the molten steel surface level at a lower side of the mold. The thermocouple interval at the upper side of the mold was changed by each level. The relative differences of β and s were approximately "0" (zero) % from the level "0" (zero) to the level 2, and it was indicated that the thermocouple interval at the upper side of the mold was enough small. Besides, when the thermocouple interval at the upper side of the mold was 120 mm, the comprehensive evaluation was o. FIG. 9 and FIG. 10 are graphic charts illustrating the typical mold temperature distribution described in the embodiment and mold temperature distributions each of which are linearly interpolated by using the temperatures at the embedding positions of the selected thermocouples regarding from the level "0" (zero) to the level 4. Table 2 is one where a root-mean-square in the casting direction is calculated as for each relative difference between the typical mold temperature distribution and the mold tempera Lure distribution which is linearly interpolated by using only the temperatures at the embedding positions of the thermocouples. Note that the posit ion at 755 mm under the molten steel surface level corresponds to the position at 250 mm from the lower end of the mold, and the temperature reaches a minimum temperature under the molten steel surface level, and therefore, the temperature at a position of 550 mm under the molten steel surface level is taken in the typical mold temperature distribution. There is a high correlation with the relative difference of β and the relative difference of s in Table 1, and therefore, it turns out that it is preferable that the thermocouples are densely embedded at the upper side of the mold where the temperature gradient is relatively large so as not to generate a large difference between the mold temperature distribution which is linearly interpolated by using the temperatures of the selected thermocouples and the original mold temperature distribution.

TABLE 2

| LEVEL | ROOT-MEAN-SQUARE [%] |
|---|---|
| 0 | 2.8 |
| 1 | 2.9 |
| 2 | 3.3 |
| 3 | 7.1 |
| 4 | 14.0 |

The solidified state in mold estimations were performed while setting the level "0" (zero) as the reference and without selecting the thermocouples at the upper side of the mold in each of the level 5 to the level 7, and without selecting the thermocouple at the lower side of the mold in the level 8. As a result, all of the comprehensive evaluations except the level 5 became Δ. It turns out from this result that it is preferable that an upper end of the range where the thermocouples are densely embedded is set at within 95 mm under the molten steel surface level, and the thermocouple is embedded in a vicinity of the minimum temperature under the molten steel surface level.

Example 2

The present example is one where performance regarding the detection of the break-out due to drift using the method of the present invention was evaluated to compare with conventional methods. In the present example, the same mold as the example 1 was used, the positions of the temperature sensing units embedded in the mold were set to the level "0" (zero) in the example 1, and the estimation of the solidified state in the mold was performed by using the temperature data obtained from all of the temperature sensing units.

As candidates of the solidified state in mold evaluation amounts, the amounts given by the expressions (51) to (54) were employed. Evaluation times were set to 1 minute, 4 minutes, 7 minutes, and 10 minutes, and evaluation points were set to an upper part, a middle part and a lower part of the mold. An examination period of the allowable limit values was set to five months, and the solidified state in mold estimation amounts, the candidates for the solidified state in mold evaluation amounts, and the casting conditions were stored as the time-series data. Regarding the classification of layers of the casting conditions, a grade width of the casting width was set to 300 mm, a grade width of the casting speed was set to 0.4 m/min, and a grade width of the super-heat was set to 10° C., and layer-classified levels $G_{01}$ to $G_{22}$ of the casting conditions were set by combinations of each grade of the casting width, the casting speed, and the super-heat. Details are illustrated in Table 3.

TABLE 3

| LAYER-CLASSIFIED LEVEL | CASTING WIDTH (mm) | CASTING SPEED Vc (m/min) | SUPER-HEAT (° C.) |
|---|---|---|---|
| G01 | 1000 ≤ W < 1300 | 0.9 ≤ Vc < 1.3 | 20 ≤ΔT < 30 |
| G02 | 1000 ≤ W < 1300 | 0.9 ≤ Vc < 1.3 | 30 ≤ΔT < 40 |
| G03 | 1000 ≤ W < 1300 | 0.9 ≤ Vc < 1.3 | 40 ≤ΔT |
| G04 | 1000 ≤ W < 1300 | 1.3 ≤ Vc < 1.7 | 10 ≤ΔT < 20 |
| G05 | 1000 ≤ W < 1300 | 1.3 ≤ Vc < 1.7 | 20 ≤ΔT < 30 |
| G06 | 1000 ≤ W < 1300 | 1.3 ≤ Vc < 1.7 | 30 ≤ΔT < 40 |
| G07 | 1000 ≤ W < 1300 | 1.3 ≤ Vc < 1.7 | 40 ≤ΔT |
| G08 | 1300 ≤ W < 1600 | 0.9 ≤ Vc < 1.3 | 10 ≤ΔT < 20 |
| G09 | 1300 ≤ W < 1600 | 0.9 ≤ Vc < 1.3 | 20 ≤ΔT < 30 |
| G10 | 1300 ≤ W < 1600 | 0.9 ≤ Vc < 1.3 | 30 ≤ΔT < 40 |
| G11 | 1300 ≤ W < 1600 | 0.9 ≤ Vc < 1.3 | 40 ≤ΔT |
| G12 | 1300 ≤ W < 1600 | 1.3 ≤ Vc < 1.7 | 10 ≤ΔT < 20 |
| G13 | 1300 ≤ W < 1600 | 1.3 ≤ Vc < 1.7 | 20 ≤ΔT < 30 |
| G14 | 1300 ≤ W < 1600 | 1.3 ≤ Vc < 1.7 | 30 ≤ΔT < 40 |
| G15 | 1300 ≤ W < 1600 | 1.3 ≤ Vc < 1.7 | 40 ≤ΔT |
| G16 | 1300 ≤ W < 1600 | 1.7 ≤ Vc | 20 ≤ΔT < 30 |
| G17 | 1600 ≤ W | 0.9 ≤ Vc < 1.3 | 20 ≤ΔT < 30 |
| G18 | 1600 ≤ W | 0.9 ≤ Vc < 1.3 | 30 ≤ΔT < 40 |
| G19 | 1600 ≤ W | 0.9 ≤ Vc < 1.3 | 40 ≤ΔT |
| G20 | 1600 ≤ W | 1.3 ≤ Vc < 1.7 | 10 ≤ΔT < 20 |
| G21 | 1600 ≤ W | 1.3 ≤ Vc < 1.7 | 20 ≤ΔT < 30 |
| G22 | 1600 ≤ W | 1.3 ≤ Vc < 1.7 | 30 ≤ΔT < 40 |

Figure 11:
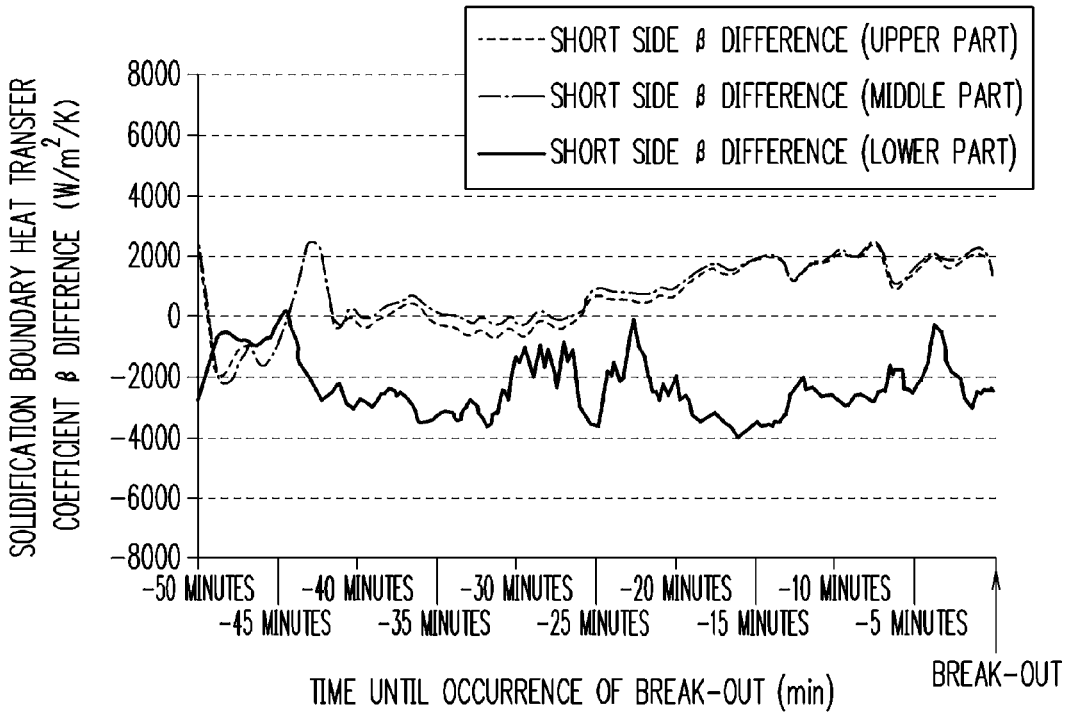
FIG. 11 is a characteristic chart illustrating a time change of short side β differences of heat transfer coefficients according to an example 2.
Figure 12:
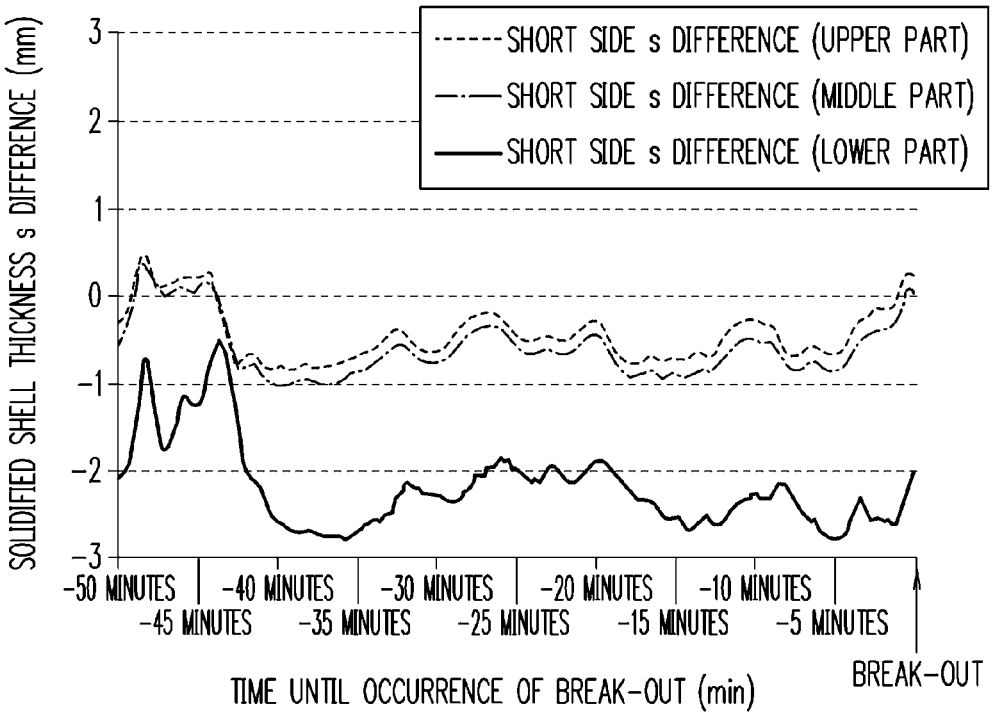
FIG. 12 is a characteristic chart illustrating a time change of short side s differences of solidified shell thicknesses according to the example 2.

On the other hand, when the state in the mold was estimated from the measurement data of the break-out due to drift being the abnormal casting which occurred in the past than the examination period of the allowable limit values, time changes until the break-out occurrence were as illustrated in FIG. 11 and FIG. 12. FIG. 11 illustrates the Lime changes of the short side β differences of the heat transfer coefficients at the upper part, the middle part, the lower part of the mold. FIG. 12 illustrates the time changes of the short side s differences of the solidified shell thicknesses at the same position.

Figure 13:
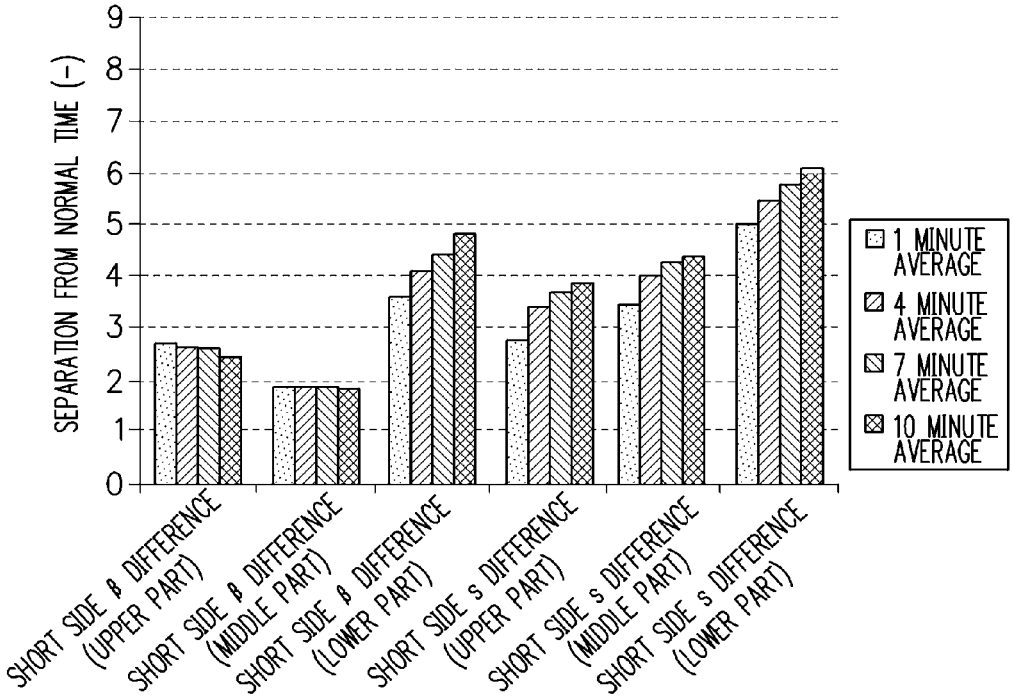
FIG. 13 is a characteristic chart illustrating a comparison of solidified state in mold evaluation amounts according to the example 2.
Figure 14:
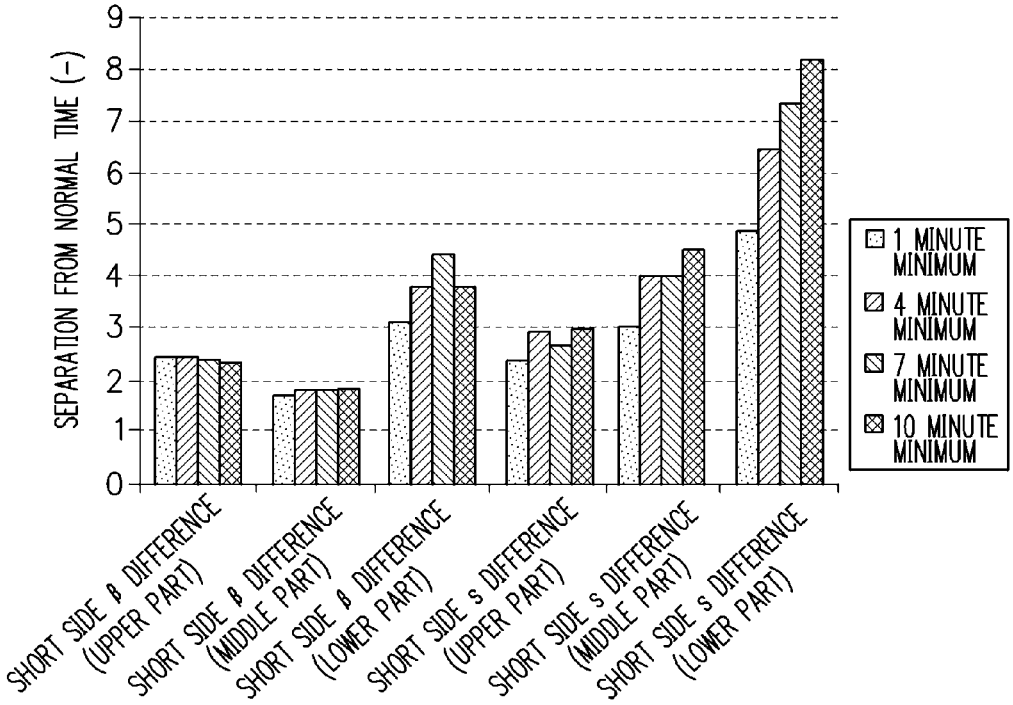
FIG. 14 is a characteristic chart illustrating a comparison of the solidified state in mold evaluation amounts according to the example 2.

The solidified state in mold evaluation amounts are compared with a normal time by using the abnormal operation cases, and separation states from the normal time are illustrated in FIG. 13 and FIG. 14.

FIG. 13 illustrates results obtained from evaluations given by the expression (55) regarding the expression (51) and the expression (52) each being the moving average. For example, the moving average from the past one second to 15 minutes of at least either of the short side β difference or the short side s difference is set as the solidified state in mold evaluation amount.

FIG. 14 illustrates results where the expression (53) and the expression (54) are evaluated by the expression (55). From FIG. 14, it turns out that the separation from the normal time is the largest when the casting state determination amount is set to the minimum value with sign of the short side s difference at the lower part of the mold when 10 minutes are set as the evaluation time. The minimum value may be the minimum value of at least either an absolute value of the short side β difference or an absolute value of the short side s difference from past one second to 15 minutes.

Figure 15:
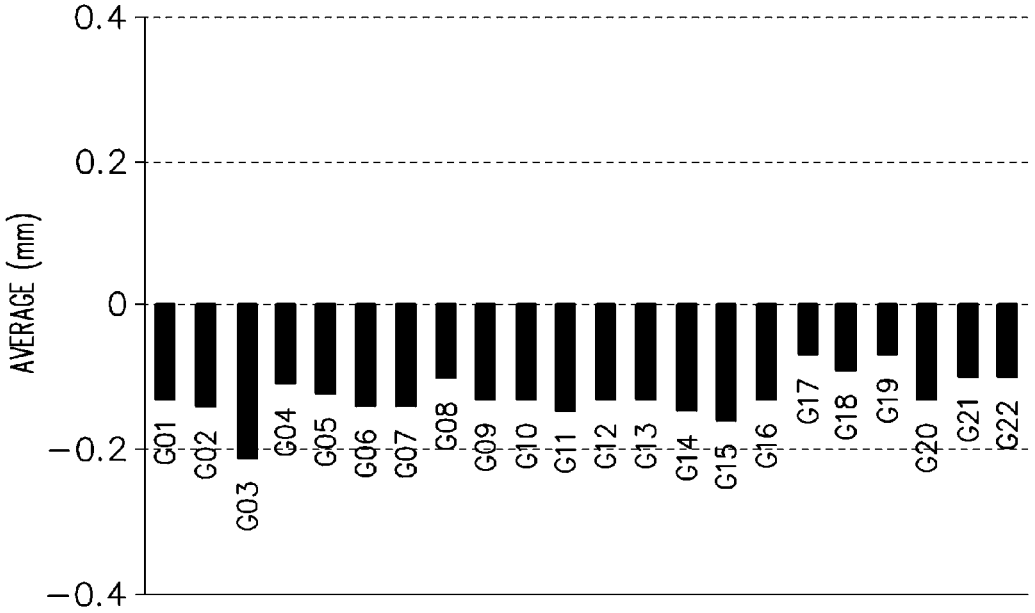
FIG. 15 is a characteristic chart illustrating a comparison of averages of casting state determination amounts which are classified by layers in the example 2.
Figure 16:
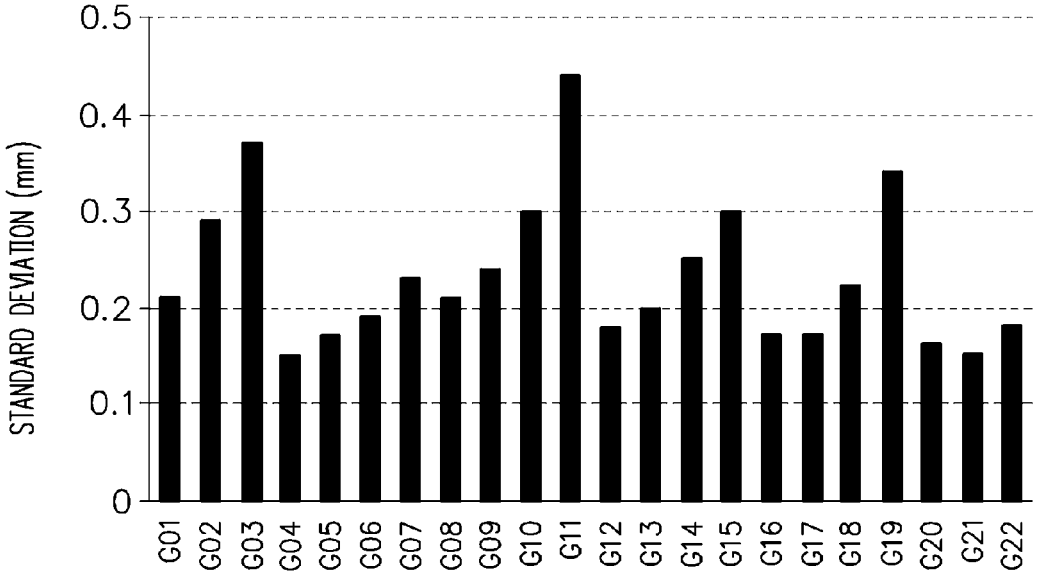
FIG. 16 is a characteristic chart illustrating a comparison of standard deviations of the casting state determination amounts which are classified by layers in the example 2.

Averages and standard deviations of the casting state determination amounts by each of the layer-classified levels $G_{01}$ to $G_{22}$ of the casting conditions become as illustrated in FIG. 15 and FIG. 16. The method of the present invention can be carried out without determining by layers of the casting conditions, but a trend is different by each layer, and therefore, it can be seen that the accuracy improves by classifying by layers.

Figure 17:
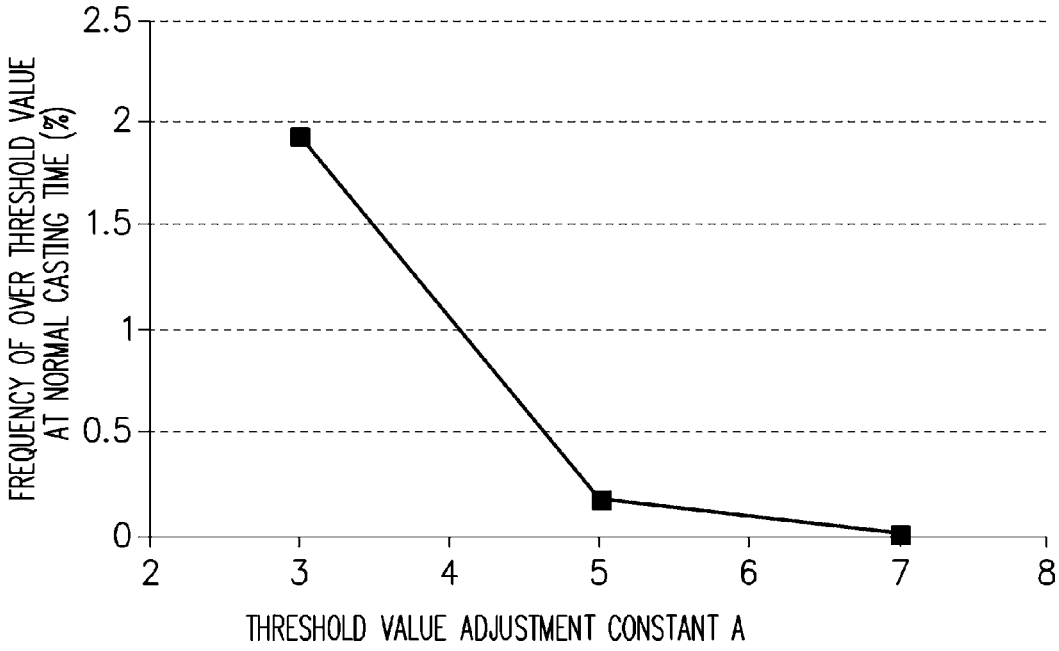
FIG. 17 is a characteristic chart illustrating a prediction value of a ratio where a normal casting is misjudged to be an abnormal casting relative to an allowable limit value adjustment constant in the example 2.
Figure 18:
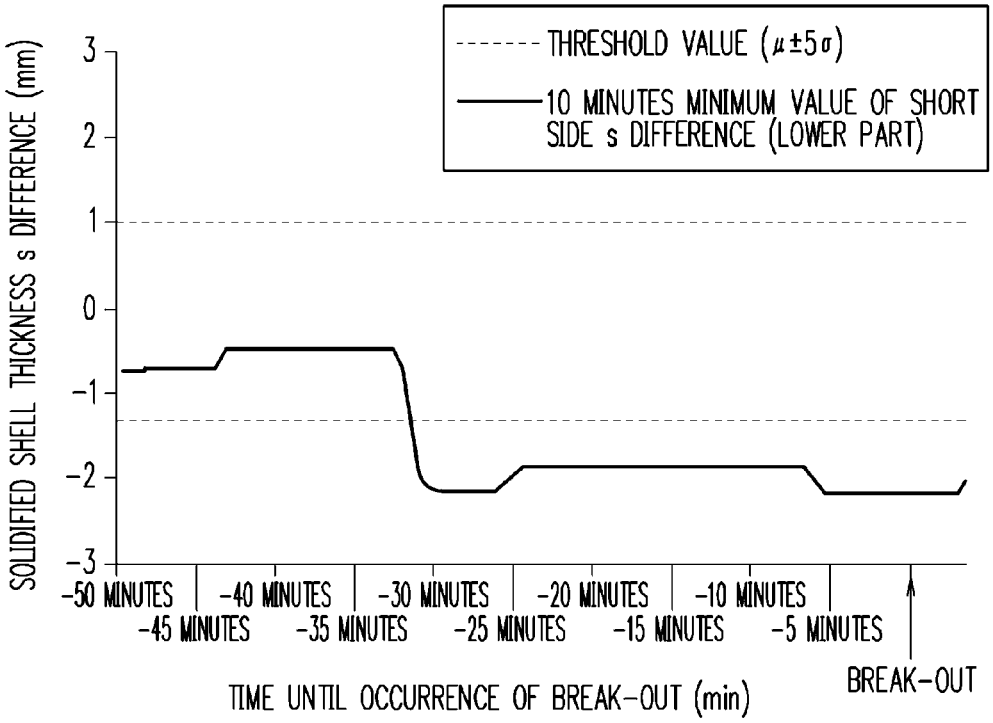
FIG. 18 is a characteristic chart illustrating changes of the allowable limit values and the casting state determination amounts where the present invention is applied in the example 2.
Figure 19:
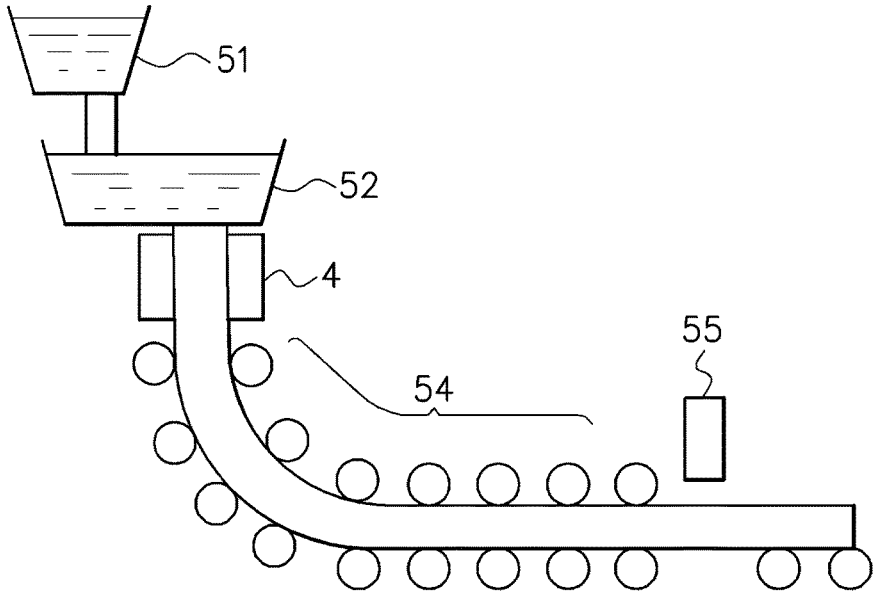
FIG. 19 PRIOR ART
FIG. 19 is a view to explain an outline of the continuous casting equipment.
Figure 20:
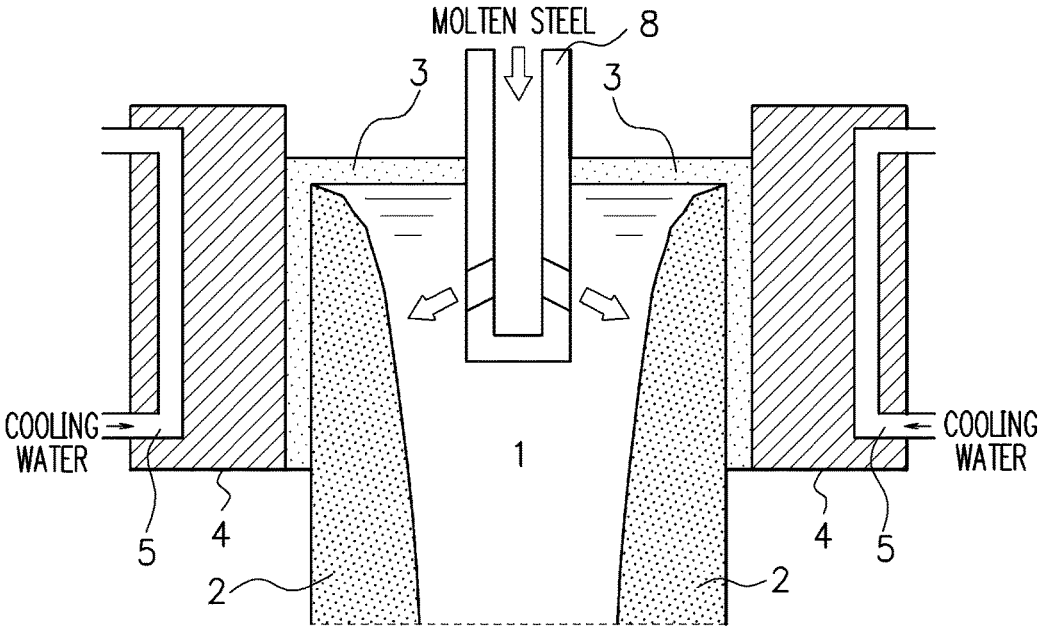
FIG. 20 PRIOR ART
FIG. 20 is a view illustrating a cross section in a vicinity of a mold of the continuous casting equipment.

FIG. 17 is a prediction value of a ratio where the normal casting is misjudged to be the abnormal casting relative to the allowable limit value adjustment constant A, and when A=5, the ratio goes below an allowable ratio of 0.2%. FIG. 18 is a graphic chart of the allowable limit values and the casting state determination amount obtained by the above-stated method in the break-out due to drift being the abnormal casting in the past, and it turns out that it is possible to predict at approximately 30 minutes before the break-out occurrence.

Comparative Example

The detection of the casting failure in the continuous casting was tried while using the method described in Patent Literature 6 as a comparative example.

The mold temperatures were measured by the temperature sensing units (a first temperature measurement point: 160 mm from an upper surface of the mold, a second temperature measurement point: 340 mm) embedded in the mold with intervals in the casting direction, and the heat flux at an inner surface of the mold at each measurement point is estimated based on the mold temperature measurement value by using the heat transfer inverse problem.

Similar to the example, when a relationship between a casting elapsed time and a heat flux estimated from the mold measurement temperature of a broken hole side short side was examined as for the measurement data of the casting where the break-out due to drift occurred, the heat flux at the position exceeded $2.4\times10^6$ W/m$^2$ at five minutes before the break-out occurrence to be an ascending trend until the break-out occurrence, and the heat flux did not decrease to a limit value or less set in advance as for the first temperature measurement point. The break-out due to drift occurs because a solidification growth is inhibited by a heat quantity exceeding a cooling capacity of the mold locally given to the solidified shell, and the solidified shell with insufficient strength is pulled outside the mold. It is therefore conceivable that the calculation result where the short side heat flux at the broken-hole side increased before the break-out occurrence was a natural result. However, in Patent Literature 6, it is supposed that the break-out "occurs because a portion where a cast slab solidified layer thickness becomes partially thin is broken due to a foreign substance inserted between the mold and the cast slab, cracks of the cast slab, and so on, and molten metal flows out", and it is assumed that "a heat transfer from the solidified layer to the mold is disturbed by an effect of the foreign substance or the cracks being causes thereof, and the lowering of the heat flux occurs", and therefore, detection objects are only ones whose heat fluxes are lowered. Accordingly, it is impossible to determine or predict the occurrence of the break-out due to drift only by applying the method of Patent Literature 6 as it is.

Besides, as a relatively easy improved method from the method in Patent Literature 6, a method is conceivable where it is predicted that the break-out occurs when the heat flux exceeds a limit value set in advance (including a case of increasing). As the limit value set in advance, it was set to $2.7\times10^6$ W/m$^2$ regarding the first temperature measurement point, and it was set to $1.9\times10^6$ W/m$^2$ regarding the second temperature measurement point. Then the heat flux at the first temperature measurement point exceeded the limit value 65 seconds before the actual break-out occurrence, and the heat flux at the second temperature measurement point exceeded the limit value 26 seconds before the actual break-out occurrence, and therefore, it was considered that there was a probability of prediction of the break-out occurrence. However, it was thought that drift leading to the break-out did not occur during two hours from three hours to one hour before the break-out occurrence, but there were times satisfying the above-stated conditions for a total of 77 seconds divided into eight-times though the break-out did not actually occur, and the detection resulted in a lot of error. Accordingly, it turned out that it was difficult to properly predict the occurrence of the break-out due to drift only by using the method in Patent Literature 6.

As stated above, though it was possible to detect the occurrence of the break-out for some extent, it was impossible to properly predict the occurrence of the break-out according to the conventional methods.

Hereinabove, the detection method of the break-out due to drift is described, but the casting state in the continuous casting is one where various physical phenomena complicatedly affect with each other, and the casting state determination amount proper for the detection of the break-out due to drift has not been obvious. Namely, it is considered that the break-out due to drift occurs because the solidified shell thickness becomes thin, but in addition, an internal stress or the like of the solidified shell affects on the occurrence of the break-out, and it cannot be said that an occurrence mechanism of the break-out due to drift in itself is enough made clear. Besides, the information obtained by the measurements is limited. For example, the internal stress of the solidified shell cannot be directly measured, and it is necessary to consider a solidified shell shape, a temperature distribution in the solidified shell, a restriction condition of the mold if the internal stress is estimated based on the measurement, but a high-speed calculation method usable in online is not proposed.

The present inventors evaluate about various indexes calculated from the solidified state in mold estimation amounts estimated by the method of the present invention, and find out the casting state determination amount capable of detecting the break-out due to drift with sufficient accuracy to detect the break-out due to drift with high accuracy under the situation as stated above.

INDUSTRIAL APPLICABILITY

The present invention is usable for determining a casting state in continuous casting where a solidified shell, a mold flux layer, and a mold exist between a molten steel to mold cooling water.

The invention claimed is:

1. A determination method of a casting state in continuous casting where there are a solidified shell, a mold flux layer, and a mold being respective thermal conductors between a molten steel and cooling water for the mold, the determination method comprising:

a first step of finding a heat transfer coefficient $\alpha$ being a heat flux per a unit temperature difference between the solidified shell and the mold sandwiching the mold flux layer and a heat transfer coefficient $\beta$ between the molten steel and the solidified shell by using data from a plurality of temperature sensing units which are embedded in the mold while shifting positions in a casting direction by solving an inverse problem, and estimating a solidified shell thickness and a solidified shell temperature from the heat transfer coefficient $\alpha$ and the heat transfer coefficient $\beta$;

a second step of setting the heat transfer coefficient α, the heat transfer coefficient β, the solidified shell estimated thickness, and the solidified shell estimated temperature found in the first step as solidified state in mold estimation amounts, and obtaining solidified state in mold evaluation amounts from the solidified state in mold estimation amounts; and a third step of determining whether a normal casting state or an abnormal casting state by comparing at least one or more kinds of amounts contained in the solidified state in mold estimation amounts and the solidified state in mold evaluation amounts obtained in the second step with allowable limit values which are found based on at least one or more kinds of amounts contained in the solidified state in mold estimation amounts and the solidified state in mold evaluation amounts when the abnormal casting occurred in a past and stored in an allowable limit value storage unit, wherein in the mold where widths in a horizontal direction of two planes which are not adjacent but face each other are equal from among four planes of mold surfaces which are in contact with a cast slab through the mold flux layer, two planes whose widths in the horizontal direction are narrower than the other two planes are called as short sides, a difference of the heat transfer coefficients β obtained at the short sides at the same mold height position is called as a short side β difference, a difference of solidified shell thicknesses obtained at the short sides at the same mold height position is called as a short side shell thickness difference, and the solidified state in mold evaluation amounts are calculated from at least either the short side β difference or the short side shell thickness difference.

2. The determination method of the casting state according to claim 1, wherein in the third step, occurrence of a break-out is determined as the determination of whether the normal casting state or the abnormal casting state.

3. The determination method of the casting state according to claim 1, further comprising:

a time-series data storing step of setting at least one or more kinds of amounts contained in the solidified state in mold estimation amounts and the solidified state in mold evaluation amounts obtained in the second step as a time-series data, and storing in a data storage unit together with information of whether or not the abnormal casting occurred; and an allowable limit value storing step of deciding allowable limit values defining a range regarded to be the normal casting state based on the time-series data when the abnormal casting occurred and statistic information including an average and a standard deviation of the time-series data, and storing in the allowable limit value storing unit.

4. The determination method of the casting state according to claim 1, wherein the solidified state in mold evaluation amount is a moving average from one second to 15 minutes in the past of at least either the short side β difference or the short side shell thickness difference.

5. The determination method of the casting state according to claim 1, wherein the solidified state in mold evaluation amount is a minimum value from one second to 15 minutes in the past of at least either an absolute value of the short side β difference or an absolute value of the short side shell thickness difference.

6. The determination method of the casting state according to claim 3, wherein at least one or more kinds of amounts contained in the solidified state in mold estimation amounts and the solidified state in mold evaluation amounts are classified by layers in accordance with classifications for casting conditions and measurement values defined in advance, and the statistic information is at least either the average or the standard deviation in each group classified by layers.

7. The determination method of the casting state according to claim 6, wherein the casting conditions and the measurement values are one or more kinds from among a casting speed, a casting width, a molten steel temperature, a difference between the molten steel temperature and a liquidus temperature, and a difference between the molten steel temperature and a solidus temperature.

8. The determination method of the casting state according to claim 3, wherein a value where one time or more value of the standard deviation is added to the average and a value where one time or more value of the standard deviation is subtracted from the average are used as the allowable limit values.

9. The determination method of the casting state according to claim 1, wherein an arbitrary position at "0" (zero) mm or more and 95 mm or less downward from a supposed molten steel surface level position of the mold is set to $P_1$, an arbitrary position at 220 mm or more and 400 mm or less downward from the molten steel surface level position is set to $P_2$, and embedding positions of the temperature sensing units are provided at intervals of 120 mm or less within a range from $P_1$ to $P_2$, and at least one point is provided at a position where a distance from a lower end of the mold is within 300 mm.

* * * * *